US011387062B2

(12) United States Patent
Nakatani et al.

(10) Patent No.: US 11,387,062 B2
(45) Date of Patent: Jul. 12, 2022

(54) ELECTRICAL CIRCUIT BREAKER

(71) Applicant: PACIFIC ENGINEERING CORPORATION, Ogaki (JP)

(72) Inventors: Takenao Nakatani, Ogaki (JP); Yusuke Kondo, Ogaki (JP)

(73) Assignee: Pacific Engineering Corporation, Ogaki (JP)

( * ) Notice: Subject to any disclaimer, the term of this patent is extended or adjusted under 35 U.S.C. 154(b) by 0 days.

(21) Appl. No.: 17/052,121

(22) PCT Filed: Apr. 19, 2019

(86) PCT No.: PCT/JP2019/016751
§ 371 (c)(1),
(2) Date: Oct. 30, 2020

(87) PCT Pub. No.: WO2019/235082
PCT Pub. Date: Dec. 12, 2019

(65) Prior Publication Data

US 2021/0233729 A1 Jul. 29, 2021

(30) Foreign Application Priority Data

Jun. 4, 2018 (JP) ..... JP2018-106641

(51) Int. Cl.
*H01H 9/30* (2006.01)
*H01H 39/00* (2006.01)
*H01H 73/18* (2006.01)

(52) U.S. Cl.
CPC ..... *H01H 39/006* (2013.01); *H01H 9/30* (2013.01); *H01H 73/18* (2013.01)

(58) Field of Classification Search
CPC .... H01H 39/006; H01H 39/002; H01H 39/00; H01H 2039/008; H01H 9/30;
(Continued)

(56) References Cited

U.S. PATENT DOCUMENTS 7,078,635 B2 * 7/2006 Kordel ..... H01H 39/006 200/61.08
7,222,561 B2 * 5/2007 Brede ..... B23D 15/145 200/61.08
(Continued)

FOREIGN PATENT DOCUMENTS

JP 2013239412 A 11/2013
JP 2014049189 A 3/2014
(Continued)

OTHER PUBLICATIONS

Translation of JP2014049272 (Original document published Mar. 17, 2014) (Year: 2014).*
(Continued)

*Primary Examiner* — William A Bolton
(74) *Attorney, Agent, or Firm* — FisherBroyles LLP; Kevin D. Jablonski

(57) ABSTRACT

An electric circuit breaker, including a housing, a cut portion that is arranged in the housing and forms a part of an electric circuit, a cutting member that cuts the cut portion, and a power source arranged on a first end portion side of the housing, the electric circuit breaker including a moving body that allows the cut portion to be inserted and accommodated therein and includes the cutting member and a first arc extinguishing space adjacent to the cutting member, in which the housing includes a cylindrical portion capable of moving the moving body between the first end portion and a second end portion on a side opposite to the first end portion. The moving body is further configured such that the cutting member provided in the moving body cuts the cut portion while the moving body moves from the first end portion toward the second end portion by the power source.

9 Claims, 23 Drawing Sheets

(58) Field of Classification Search
CPC ..... H01H 73/18; H01H 73/36; H01H 73/60; H01H 73/64; H01H 85/02; H01H 85/0039; H01H 85/045; H01H 85/00; H01H 37/76; H01H 69/02
USPC ..... 200/61.08, 61.09, 300; 337/401; 218/95
See application file for complete search history.

(56) References Cited

U.S. PATENT DOCUMENTS

| | | | | |
|---|---|---|---|---|
| 7,498,531 | B2 * | 3/2009 | Knauss | H01H 39/006 200/61.08 |
| 7,511,600 | B2 * | 3/2009 | Von Behr | H01H 39/006 200/61.08 |
| 8,432,246 | B2 * | 4/2013 | Suzuki | H01H 39/006 337/157 |
| 2014/0061011 | A1 * | 3/2014 | Nakamura | H01H 39/00 200/61.08 |

FOREIGN PATENT DOCUMENTS

| | | | |
|---|---|---|---|
| JP | 2014049272 | A | 3/2014 |
| JP | 2014049300 | A | 3/2014 |
| WO | 2015117998 | A | 8/2015 |

OTHER PUBLICATIONS

Translation of JP2013239412 (original document published Nov. 28, 2013) (Year: 2013).*
International Search Report & Written Opinion dated Jul. 23, 2019; PCT Application No. PCT/JP2019/016751 filed Apr. 19, 2019; pp. 1-7.

* cited by examiner

ELECTRICAL CIRCUIT BREAKER

CLAIM TO PRIORITY APPLICATIONS

The present application is a National Stage Application of PCT Application serial No. PCT/JP2019/016751, filed Apr. 19, 2019, which claims priority to Japanese Patent Application No. 2018-106641 Jun. 4, 2018, all of which are incorporated herein by reference in their entireties.

BACKGROUND

The present subject matter relates to an electric circuit breaker that can be used mainly for electric circuits of automobiles and the like.

Conventionally, an electric circuit breaker has been used to protect an electric circuit mounted on an automobile or the like and various electric components connected to the electric circuit. More specifically, when an abnormality occurs in the electric circuit, the electric circuit breaker physically cuts off the electric circuit by cutting a part of the electric circuit.

There are various types of the electric circuit breaker, and for example, in an electric circuit breaker 700 of Patent Literature 1 shown in FIG. 23, a dielectric 710 forming a part of an electric circuit is inserted through cutting chambers 721 in a housing 720 and accommodated therein, and the dielectric 710 is physically cut by a punch 730. The punch 730 punches the dielectric 710 in the cylindrical cutting chambers 721 so as to cross the dielectric 710, and the punched conductors 710 are in a separated state. However, there is a problem that, immediately after the dielectric 710 is punched, the distance between the punched and separated conductor 710 and the conductor 710 that remains in the housing is short, and an arc is generated between them.

Therefore, in view of the above problems, the present disclosure provides an electric circuit breaker capable of effectively extinguishing an arc generated immediately after an electric circuit is cut off.

According to the present disclosure, there is provided an electric circuit breaker, including a housing, a cut portion that is arranged in the housing and forms a part of an electric circuit, a cutting member that cuts the cut portion, and a power source arranged on a first end portion side of the housing, the electric circuit breaker including a moving body that allows the cut portion to be inserted and accommodated therein and includes the cutting member and a first arc extinguishing space adjacent to the cutting member, in which the housing includes a cylindrical portion capable of moving the moving body between the first end portion and a second end portion on a side opposite to the first end portion, in which the moving body is configured such that the cutting member provided in the moving body cuts the cut portion while the moving body moves from the first end portion toward the second end portion by the power source, and in which the first arc extinguishing space of the moving body is configured to be located between a separation piece of the cut portion that is cut and separated and a main body portion of the cut portion that remains in the housing without being separated when the moving body moves.

According to the above feature, the moving body itself includes the cutting member that cuts the cut portion and the first arc extinguishing space, and the first arc extinguishing space is configured to be located between the separation piece that is cut and separated and the main body portion that remains in the housing without being separated immediately after the cutting member cuts the separation piece and cuts off the electric circuit. Therefore, immediately after the electric circuit is cut off, the arc generated from the main body portion can be released into the first arc extinguishing space and extinguished.

According to the present disclosure, there is provided an electric circuit breaker, including a housing, a cut portion that is arranged in the housing, forms a part of an electric circuit, and is constituted by a fuse, and a power source arranged on a first end portion side of the housing, the electric circuit breaker including a moving body that allows the cut portion to be inserted and accommodated therein and includes a first arc extinguishing space filled with an arc extinguishing material, in which the housing includes a cylindrical portion capable of moving the moving body between the first end portion and a second end portion on a side opposite to the first end portion, in which the moving body is configured to cut the cut portion accommodated in the arc extinguishing space of the moving body while moving from the first end portion toward the second end portion by the power source, and in which the first arc extinguishing space of the moving body is configured to be located between a separation piece of the cut portion that is cut and separated and a main body portion of the cut portion that remains in the housing without being separated when the moving body moves.

According to the above feature, the moving body itself includes the first arc extinguishing space that accommodates the cut portion and in which the cut portion is cut, and the first arc extinguishing space is configured to be located between the separation piece that is cut and separated and the main body portion that remains in the housing without being separated immediately after the separation piece is cut and the electric circuit is cut off. Therefore, immediately after the electric circuit is cut off, the arc generated from the main body portion can be released into the first arc extinguishing space and effectively extinguished by the arc extinguishing material in the first arc extinguishing space.

In the electric circuit breaker according to the present disclosure, the moving body includes insulating spaces that are insulated from each other, and the insulating spaces are configured to face the main body portion of the cut portion when the moving body further moves toward the second end portion.

According to the above feature, the insulating spaces are configured to face the main body portion of the cut portion that remains in the housing after the moving body further moves. Thus, even if a high voltage is applied to the main body portions on both sides and arcs are generated from the main body portions, the arcs are confined in the insulating spaces and insulated from each other, so that it is possible to prevent the arcs from connecting between the main body portions and causing a current to flow in the electric circuit.

In the electric circuit breaker according to the present disclosure, the moving body includes a second arc extinguishing space on a side opposite to the first arc extinguishing space across the cutting member.

According to the above feature, since the second arc extinguishing space is provided on the side opposite to the first arc extinguishing space with the cutting member interposed therebetween, the arc that advances from the separation piece toward the second end is the second extinguishing space. It is released into the arc space and extinguished.

In the electric circuit breaker according to the present disclosure, the housing includes a third arc extinguishing space that accommodates an arc extinguishing material outside the cylindrical portion, and the third arc extinguishing space allows the main body portion to be accommodated and inserted therein.

According to the above feature, since the main body portion of the cut portion is inserted and accommodated in the third arc extinguishing space, the arc generated from the main body portion can be extinguished by the arc extinguishing material in the third arc extinguishing space.

In the electric circuit breaker according to the present disclosure, a part of the main body portion of the cut portion includes a bent portion that is bent in the third arc extinguishing space.

According to the above feature, since the bent portion of the main body portion of the cut portion is bent in the third arc extinguishing space, the contact area between the bent portion and the arc extinguishing material in the third arc extinguishing space is increased. As a result, the arc extinguishing performance of extinguishing the arc generated from the main body portion is improved.

As described above, according to the electric circuit breaker of the present disclosure, it is possible to effectively extinguish the arc generated immediately after the electric circuit is cut off.

BRIEF DESCRIPTION OF THE DRAWINGS

The subject matter presented herein will now be described, by way of example, with reference to the accompanying drawings, in which:

FIG. 1(*b*) is a plan view of the lower housing.

FIG. 2(*c*) is a bottom view of the upper housing.

FIG. 3(*c*) is a side view of the moving body.

FIG. 4(*b*) is a plan view of the cut portion.

Figure 1A:
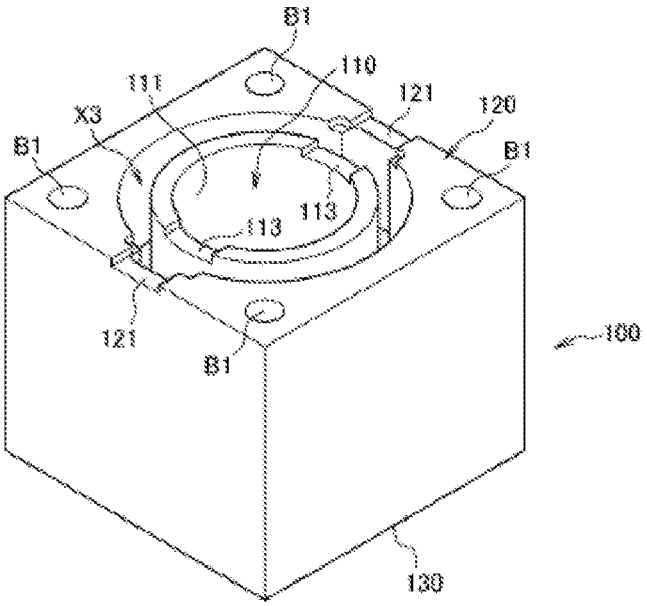
FIG. 1(*a*) is an overall perspective view of a lower housing that constitutes a housing of an electric circuit breaker according to a first embodiment of the present disclosure.

300 housing
310 cylindrical portion
320 first end portion
330 second end portion
400 cut portion
420 separation piece
430 main body portion
500 moving body
511 cutting member
P power source
X1 first arc extinguishing space
M arc extinguishing material

DETAILED DESCRIPTION

Each of embodiments of the present disclosure will be described below with reference to the drawings. The shape, material, etc. of each member of an electric circuit breaker according to the embodiments described below are examples, and the present disclosure is not limited to these.

First Embodiment

Figure 1B:
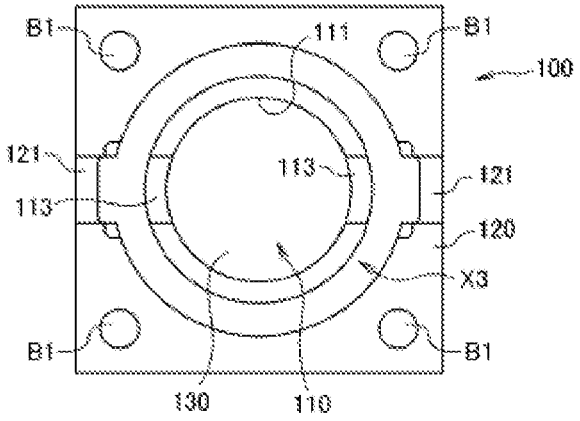

First, FIG. 1 shows a lower housing 100 that constitutes a housing 300 according to a first embodiment of the present disclosure. FIG. 1(*a*) is an overall perspective view of the lower housing 100, and FIG. 1(*b*) is a plan view of the lower housing 100. The lower housing 100 is a substantially quadrangular prism body made of synthetic resin, and includes a cylindrical lower cylindrical portion 110, and a third arc extinguishing space X3 formed in an annular shape around the lower cylindrical portion 110. The lower cylindrical portion 110 extends from an upper surface 120 of the lower housing 100 toward a lower surface 130, and is configured to be able to accommodate a moving body 500 described later. In addition, an inner surface 111 of the lower cylindrical portion 110 is a smooth curved surface so that the moving body 500 can slide therein in the vertical direction. Further, at a part of the upper end of the lower cylindrical portion 110, mounting portions 113 that are recessed according to the shapes of main body portions 430 are provided so that the main body portions 430 of a cut portion 400 described later can be mounted. The mounting portions 113 are arranged so as to face each other on both sides of the lower cylindrical portion 110, and the mounting portions 113 support the linearly extending cut portion 400 on both sides.

The third arc extinguishing space X3 has the shape of a groove extending from the upper surface 120 of the lower housing 100 toward the lower surface 130, and surrounds the outer side of the lower cylindrical portion 110 in an annular shape. The third arc extinguishing space X3 is configured to be able to accommodate an arc extinguishing material described later. The third arc extinguishing space X3 is formed in an annular shape so as to surround the periphery of the lower cylindrical portion 110, but is not limited to this, and, for example, the outer arc extinguishing space X3 may be partially formed in only portions adjacent to the mounting portions 113 of the lower cylindrical portion 110. As will be described later, an arc is generated from the end portion 431 of the main body portion 430, which is a boundary with a separation piece 420 of the cut portion 400 as a starting point. Thus, if the third arc extinguishing space X3 is provided in the portions adjacent to the mounting portions 113 in which the maim body portions 430 are accommodated, arc extinguishing materials in the third arc extinguishing space X3 can extinguish the arc.

Further, at the upper surface 120 of the lower housing 100, mounting portions 121 that are recessed according to the shapes of the main body portions 430 are provided so that the main body portions 430 of the cut portion 400 described later can be mounted. The mounting portions 121 are arranged so as to face each other on both sides of the upper surface 120, and are linearly aligned with the mounting portions 113. Therefore, the mounting portions 121 can support the linearly extending cut portion 400 on both sides. Further, connecting holes B1 are formed at four corners of the upper surface 120 of the lower housing 100, and the connecting holes B1 are arranged so as to vertically match connecting holes B2 of an upper housing 200 described later.

Figure 2A:
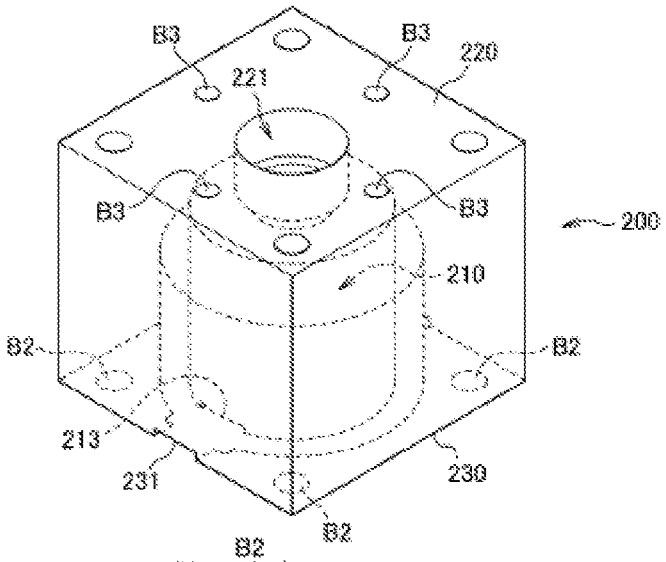
FIG. 2(*a*) is a perspective view of an upper housing that constitutes the housing of the electric circuit breaker according to the first embodiment of the present disclosure as seen from the upper side, FIG. 2(*b*) is a perspective view of the upper housing as seen from the lower side.
Figure 2B:
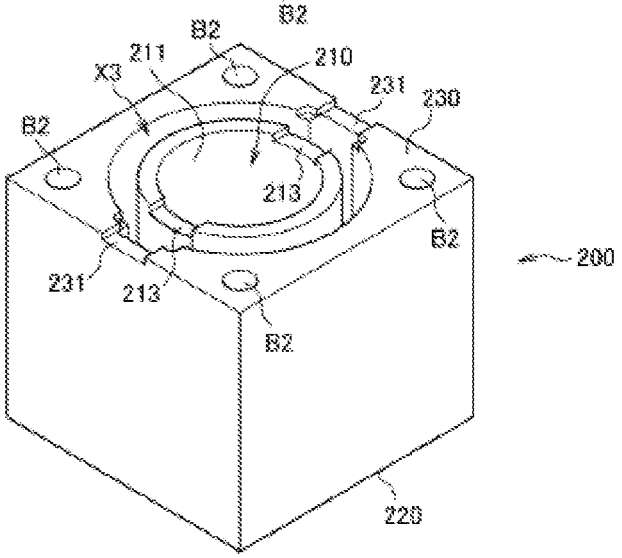
Figure 2C:
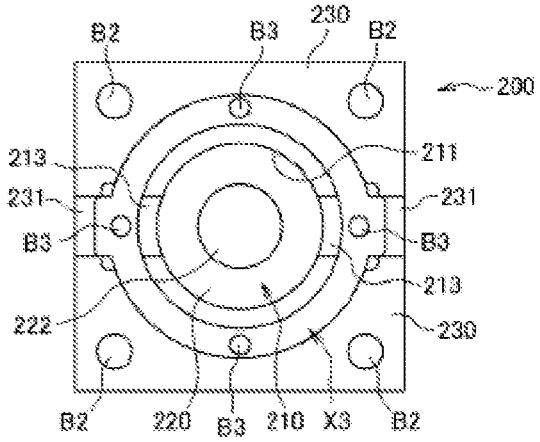

Next, FIG. 2 shows the upper housing 200 that constitutes the housing 300 according to the first embodiment of the present disclosure. FIG. 2(*a*) is a perspective view of the upper housing 200 seen from an upper surface 220 side, FIG. 2(*b*) is a perspective view of the upper housing 200 seen from a lower surface 230 side, and FIG. 2(*c*) is a bottom view of the upper housing 200.

The upper housing 200 is a substantially quadrangular prism body made of synthetic resin and forms a pair with the lower housing 100 shown in FIG. 1 Then, the upper housing 200 includes a cylindrical upper cylindrical portion 210 and a third arc extinguishing space X3 formed in an annular shape around the upper cylindrical portion 210. The upper cylindrical portion 210 extends from the lower surface 230 of the upper housing 200 toward the upper surface 220, and is configured to be able to accommodate the moving body 500 described later. In addition, an inner surface 211 of the upper cylindrical portion 210 is a smooth curved surface so that the moving body 500 can slide therein in the vertical direction. As will be described later, the upper cylindrical portion 210 is arranged with the lower cylindrical portion 110 of the lower housing 100 in a vertical relationship to form a linearly extending cylindrical portion 310, and the inner diameter of the upper cylindrical portion 210 matches the inner diameter of the lower cylindrical portion 110. Therefore, the moving body 500 can smoothly move up and down in the cylindrical portion 310.

Further, at a part of the end portion of the upper cylindrical portion 210, mounting portions 213 that are recessed according to the shapes of the main body portions 430 of the cut portion 400 described later are provided. The mounting portions 213 are arranged so as to face each other on both sides of the upper cylindrical portion 210, and are arranged at positions corresponding to the mounting portions 113 of the lower housing 100. Therefore, the mounting portions 213 are fitted from above onto the main body portions 430 of the cut portion 400 placed on the mounting portions 113 of the lower housing 100.

The third arc extinguishing space X3 has the shape of a groove extending from the lower surface 230 of the upper housing 200 toward the upper surface 220, and surrounds the outer side of the upper cylindrical portion 210 in an annular shape. The third arc extinguishing space X3 is configured to be able to accommodate the arc extinguishing material. The third arc extinguishing space X3 of the upper housing 200 is arranged at a position corresponding to the third arc extinguishing space X3 of the lower housing 100. When the lower housing 100 and the upper housing 200 are connected and fixed, the third arc extinguishing space X3 of the lower housing 100 and the third arc extinguishing space X3 of the upper housing 200 communicate with each other.

In addition, the lower surface 230 of the upper housing 200 includes mounting portions 231 that are recessed according to the shapes of the main body portions 430 of the cut portion 400 described later. The mounting portions 231 are arranged so as to face each other on both sides of the lower surface 230, and are linearly aligned with the mounting portions 213. Further, the mounting portions 231 are arranged at positions corresponding to the mounting portions 121 of the lower housing 100. Therefore, the mounting portions 231 are fitted from above onto the main body portions 430 of the cut portion 400 placed on the mounting portions 121 of the lower housing 100.

Further, at a part of the upper surface 220 of the upper housing 200, a power source accommodating portion 221 for accommodating a power source P is formed. A communication hole 222 that communicates with the upper surface of the upper cylindrical portion 210 is formed on the bottom surface side of the power source accommodating portion 221. As will be described later in detail, power such as air pressure generated from the power source P accommodated in the power source accommodating portion 221 is transmitted to the inside of the upper cylindrical portion 210 through the communication hole 222, and moves the moving body 500 inside the upper cylindrical portion 210. Furthermore, through holes B3 are formed in the upper surface 220, and these through holes B3 communicate with the third arc extinguishing space X3 inside the upper housing 200. Therefore, after the housing 300 is assembled, the arc extinguishing material can be flowed into the third arc extinguishing spaces X3 from the outside through the through holes B3. The lower housing 100 and the upper housing 200 are substantially rectangular prism bodies made of synthetic resin, but are not limited to this, and other materials may be used to form any shape as long as they have high insulation and strength that can withstand use.

Figure 3A:
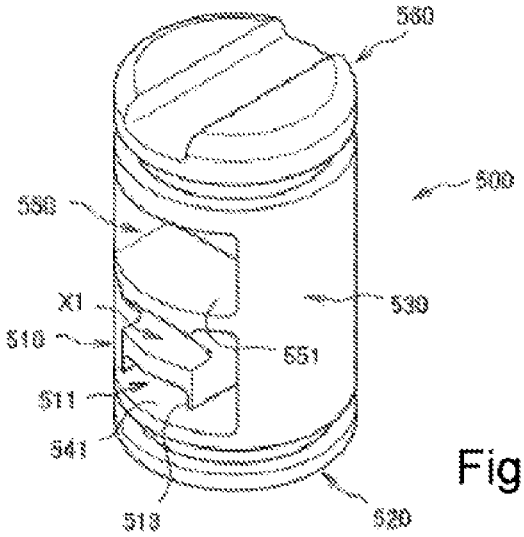
FIG. 3(*a*) is a perspective view of a moving body of the electric circuit breaker according to the first embodiment of the present disclosure, FIG. 3(*b*) is a front view of the moving body.
Figure 3B:
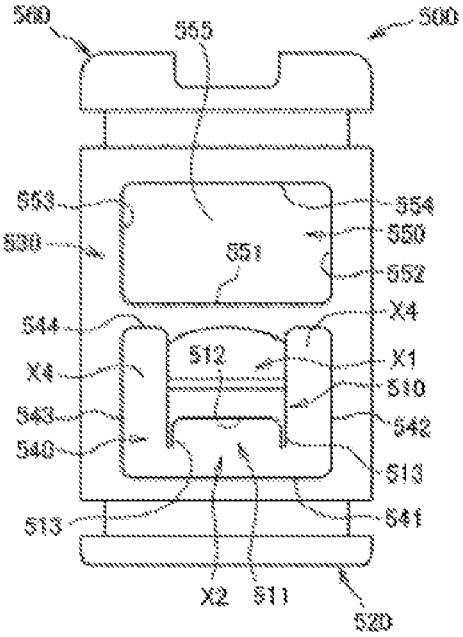
Figure 3C:
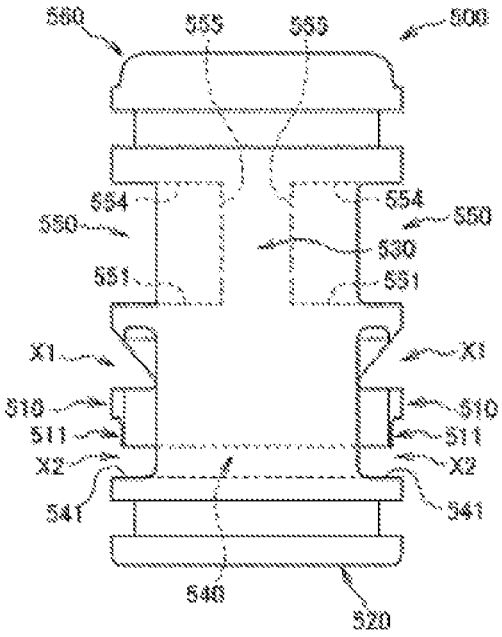

Next, FIG. 3 shows the moving body 500 according to the first embodiment of the present disclosure. FIG. 3(*a*) is a perspective view of the moving body 500, FIG. 3(*b*) is a front view of the moving body 500, and FIG. 3(*c*) is a side view of the moving body 500. The moving body 500 is a substantially columnar body made of synthetic resin and having an upper surface 560 and a lower surface 520. The outer diameter of the moving body 500 is equal to or smaller than the inner diameter of the cylindrical portion 310, and an outer surface 530 of the moving body 500 is a smooth surface corresponding to the inner surface shape of the cylindrical portion 310, so that the moving body 500 can slide the inside of the cylindrical portion 310 smoothly without gaps.

Further, on the lower surface 520 side of the moving body 500, there is provided a penetrating portion 540 which penetrates the moving body 500 from one part of the outer surface 530 to another part of the outer surface 530 on the opposite side, that is, from the front surface to the back surface of the moving body 500, and the penetrating portion 540 is surrounded by a lower wall 541, a side wall 542, a side wall 543, and an upper wall 544. Furthermore, inside the penetrating portion 540, protruding portions 510 protrude from the upper wall 544 toward the lower wall 541. First arc extinguishing spaces X1 that are recessed inward from the outer surface 530 are formed on the root sides of the protruding portions 510. A space between a cutting member 511 of the penetrating portion 540 and the lower wall 541 is larger than the cut portion 400 so that the separation piece 420 and the main body portions 430 of the cut portion 400 can be inserted, as will be described later.

Further, the cutting member 511 is formed on the tip sides of the protruding portion 510. As shown in FIG. 3(*b*), the cutting member 511 has a substantially U-shaped vertical cross section, and has an abutment surface 512 that comes into abutment against the surface of the separation piece 420 of the cut portion 400, and holding surfaces 513 that protrude from both sides of the abutment surface 512 and are configured to sandwich side surfaces 423 of the separation piece 420.

Further, the first arc extinguishing spaces X1 are arranged so as to be adjacent to the cutting member 511 on the side opposite to the separation piece 420 across the cutting members 511, and have a shape recessed inward from the outer surface 530 of the moving body 500. An arc extinguishing material can be optionally accommodated in the first arc extinguishing spaces X1. Further, an arc extinguishing material can be optionally accommodated in a second arc extinguishing space X2 between the cutting member 511 and the lower wall 541. Similarly, an arc extinguishing material can be optionally accommodated in a fourth arc extinguishing space X4 between the protruding portion 510 and each of the side wall 542 and the side wall 543. Therefore, the periphery of the separation piece 420 of the cut portion 400 arranged so as to come into abutment against the cutting member 511 can be surrounded by the arc extinguishing material.

Further, insulating spaces 550 that are recessed inward from the outer surface 530 are formed on the upper surface 560 side of the moving body 500. The insulating spaces 550 are formed at opposite positions on the outer surface 530. The insulating spaces 550 are each surrounded by a lower wall 551, a side wall 552, a side wall 553, an upper wall 554, and a rear wall 555. As shown in FIG. 3(*c*), the insulating spaces 550 arranged so as to face each other are shielded from each other by the rear wall 555, and are spaces insulated from each other. An arc extinguishing material is not accommodated in the insulating spaces 550, and an arc is confined and shielded as will be described later. Further, the insulating spaces 550 and the penetrating portion 540 are shielded from each other by the lower walls 551 and the upper walls 544, and are independent spaces that are insulated from each other. Similarly, the insulating spaces 550 and the first arc extinguishing spaces X1 are also shielded from each other by the lower walls 551 and the upper walls 544, and are independent spaces insulated from each other.

Note that the moving body 500 has a columnar shape made of synthetic resin, but is not limited to this, and other materials may be used to form any shape as long as it has high insulation and strength that can withstand use.

Figure 4A:
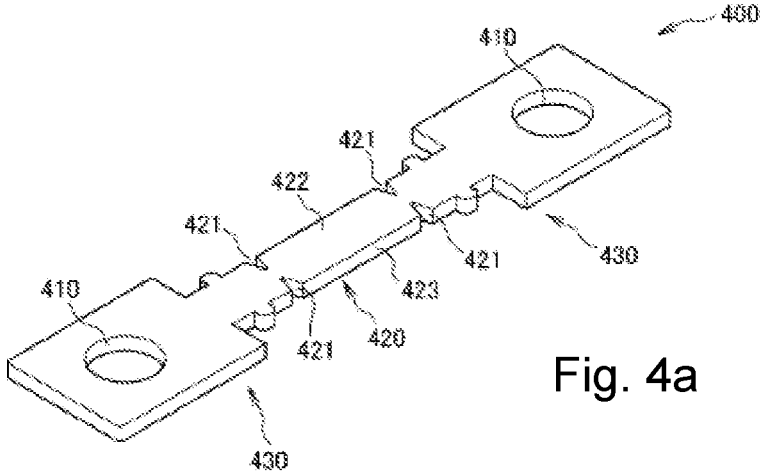
FIG. 4(*a*) is a perspective view of a cut portion of the electric circuit breaker according to the first embodiment of the present disclosure.
Figure 4B:
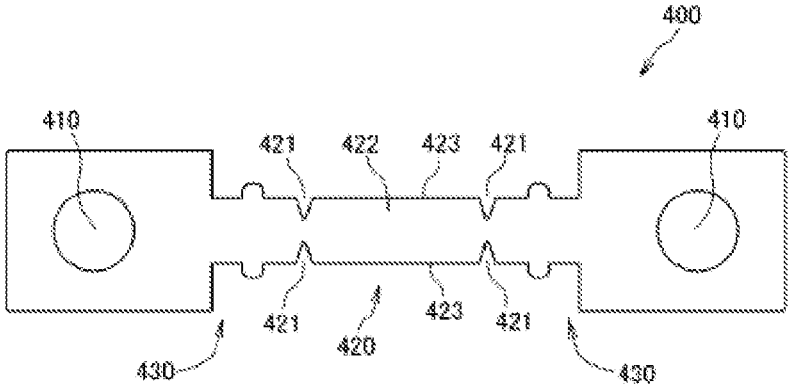

Next, FIG. 4 shows the cut portion 400 that constitutes a part of an electric circuit which is cut off by an electric circuit breaker 600 according to the first embodiment of the present disclosure. FIG. 4(*a*) is a perspective view of the cut portion 400, and FIG. 4(*b*) is a plan view of the cut portion 400. The cut portion 400 is entirely made of a metal conductor in order to electrically connect to an electric circuit, and includes the main body portions 430 for connecting to the electric circuit at both ends, and the separation piece 420 to be cut and separated at substantially the center. Connection holes 410 used for connection to an electric circuit are formed at the end portions of the main body portions 430. Further, notches 421 are formed on both sides of the separation piece 420 so that the separation piece 420 can be easily cut and separated. The abutment surface 512 of the cutting member 511 of the moving body 500 shown in FIG. 3 come into abutment against a surface 422 of the separation piece 420, and the holding surfaces 513 of the cutting member 511 come into abutment against the side surfaces 423 on both sides.

Figure 5:
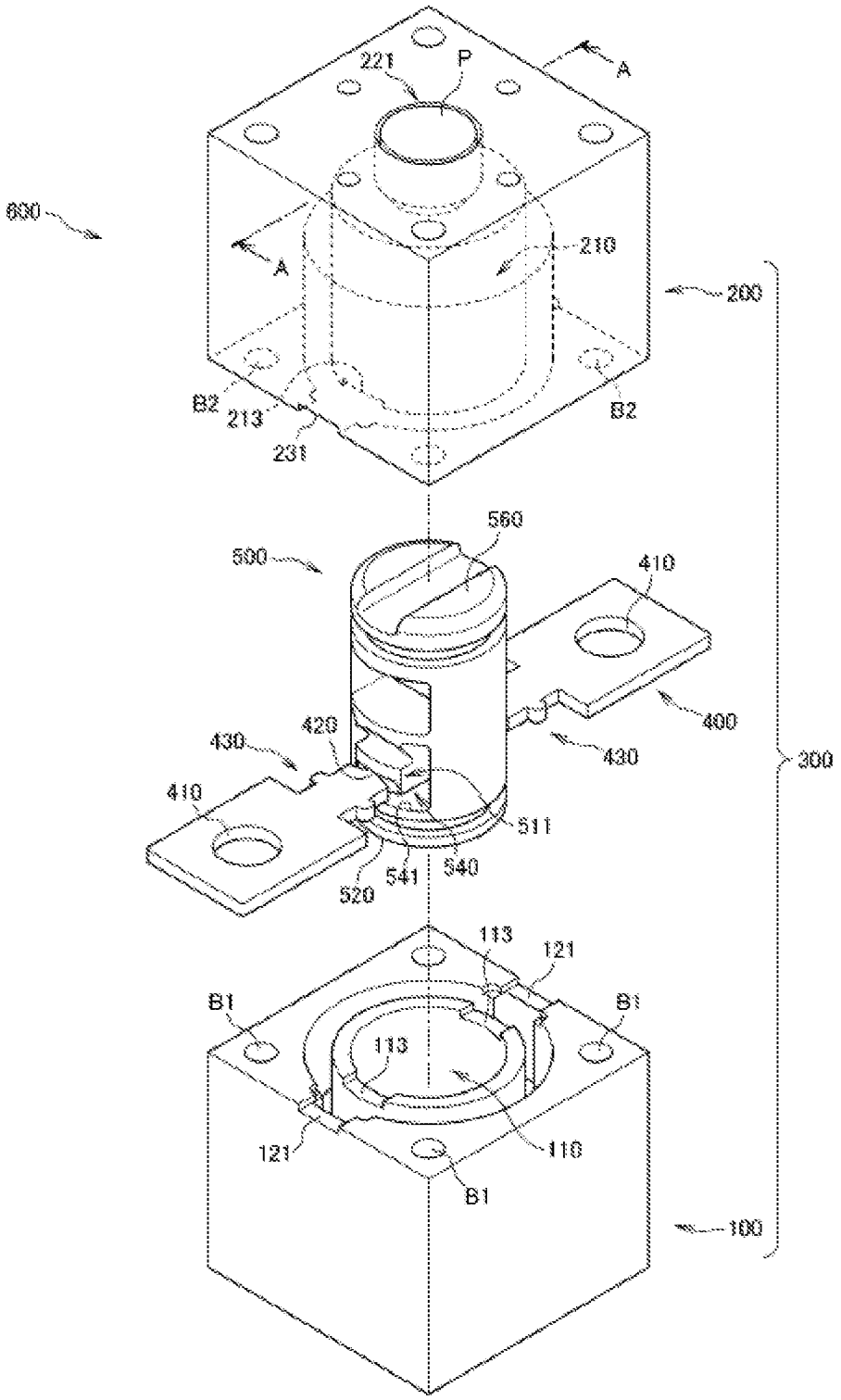
FIG. 5 is an exploded perspective view of the electric circuit breaker according to the first embodiment of the present disclosure.

Next, how to assemble the electric circuit breaker 600 of the present disclosure will be described with reference to FIG. 5. FIG. 5 shows an exploded perspective view of the electric circuit breaker 600.

First, in the penetrating portion 540 of the moving body 500, the main body portions 430 of the cut portion 400 are inserted between the cutting member 511 and the lower wall 541, and the cut portion 400 is inserted up to a position at which the separation piece 420 of the cut portion 400 faces the cutting member 511 of the moving body 500. Then, as shown in FIG. 5, the separation piece 420 of the cut portion 400 is inserted and accommodated inside the moving body 500.

Next, the moving body 500 is inserted from the lower surface 520 side into the lower cylindrical portion 110 of the lower housing 100. Then, the main body portions 430 of the cut portion 400 are placed so as to be fitted into the mounting portions 113 and the mounting portions 121 of the lower housing 100, and the moving body 500 is fixed inside the lower cylindrical portion 110. Next, the upper housing 200 is fitted from above the lower housing 100 so that the upper surface 560 of the moving body 500 is inserted into the upper cylindrical portion 210 of the upper housing 200. Then, by pushing the upper housing 200 toward the lower housing 100, the mounting portions 213 and the mounting portions 231 of the upper housing 200 are fitted to the main body portions 430 of the cut portion 400. The connecting holes B1 and the connecting holes B2 arranged vertically are connected and fixed by a connecting member or the like, so that the housing 300 including the lower housing 100 and the upper housing 200 is assembled under a state of accommodating the cut portion 400 and the moving body 500 therein.

Further, the power source P is mounted to the power source accommodating portion 221 of the upper housing 200. When an abnormality signal is input from the outside when an abnormal current flowing in the electric circuit is detected, the power source P explodes, for example, explosive powder inside the power source P, and the air pressure resulting from the explosion causes the moving body 500 to be instantly pushed out inside the cylindrical portion 310 so as to be moved. The power source P is not limited to a power source using explosive powder as long as it generates power to move the moving body 500, and other known power sources may be used.

Figure 6:
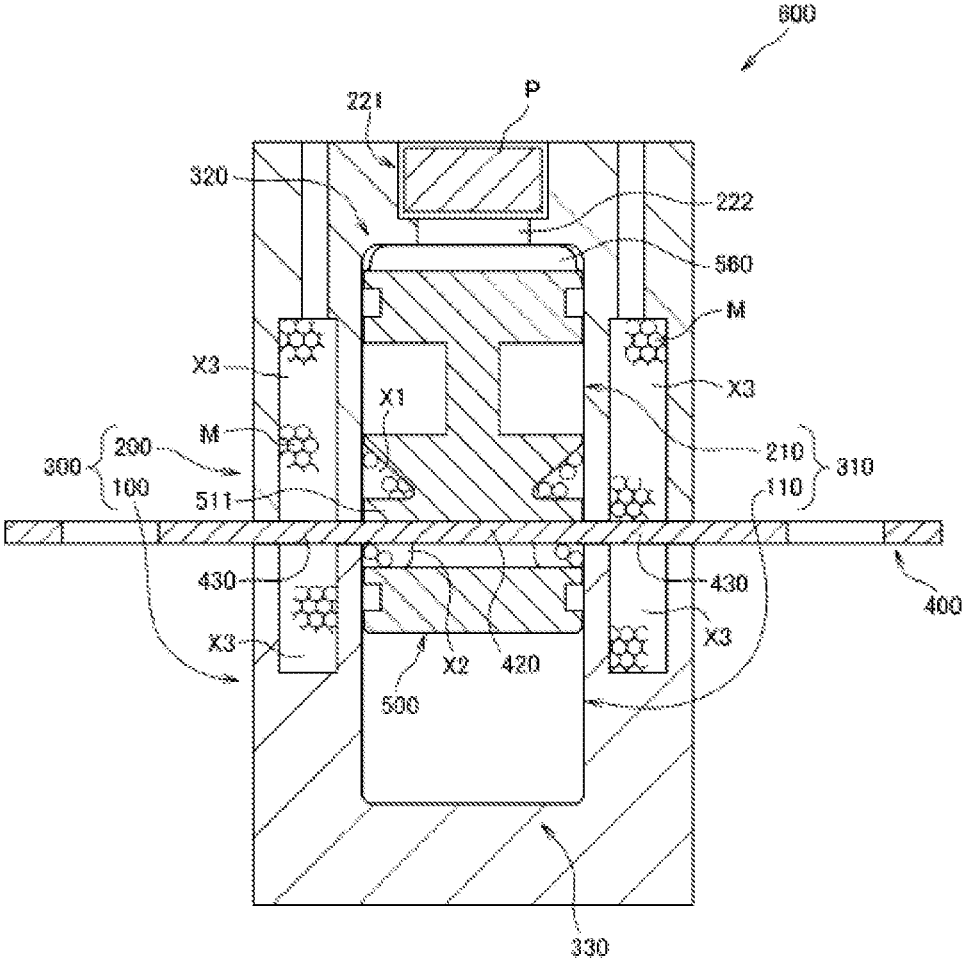
FIG. 6 is a cross-sectional view taken along the line A-A in a state where the electric circuit breaker shown in FIG. 5 is assembled.

Next, the internal structure of the electric circuit breaker 600 according to the first embodiment of the present disclosure will be described with reference to FIG. 6. FIG. 6 is a cross-sectional view taken along the line A-A in a state where the electric circuit breaker 600 shown in FIG. 5 is assembled.

As shown in FIG. 6, the moving body 500 is accommodated inside the cylindrical portion 310 composed of the lower cylindrical portion 110 and the upper cylindrical portion 210 which are linearly arranged. The cylindrical portion 310 extends from a first end portion 320 of the housing 300 to a second end portion 330 on a side opposite to the first end portion 320. Since the moving body 500 is arranged on the first end portion 320 side where the power source P is arranged, the second end portion 330 side of the cylindrical portion 310 is hollow. Therefore, as will be described later, the moving body 500 can move toward the second end portion 330 side while cutting and separating the separation piece 420. In addition, the upper surface 560 of the moving body 500 is adjacent to the power source P mounted inside the power source accommodating portion 221. As will be described later, the air pressure due to the explosion of the explosive powder in the power source P is transmitted to the upper surface 560 of the moving body 500 via the communication hole 222.

Figure 7:
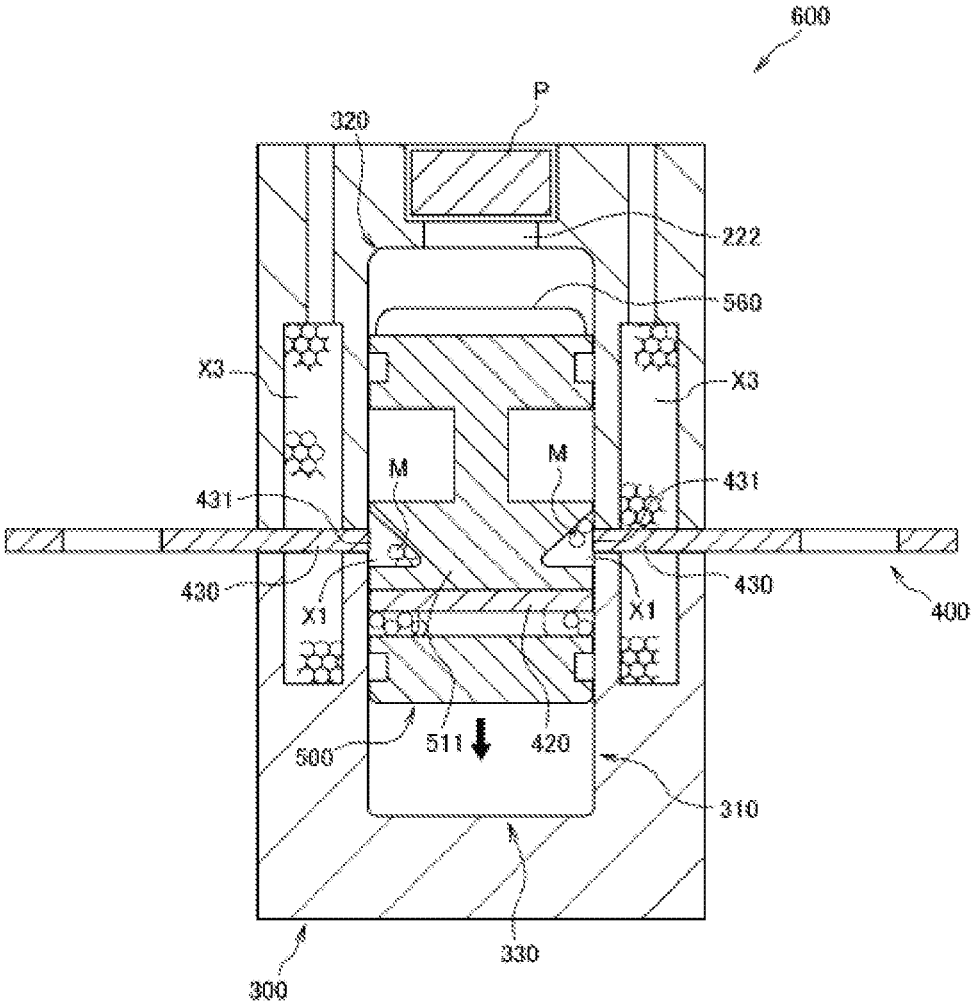
FIG. 7 is a cross-sectional view showing a state where the moving body moves from the state shown in FIG. 6.
Figure 8:
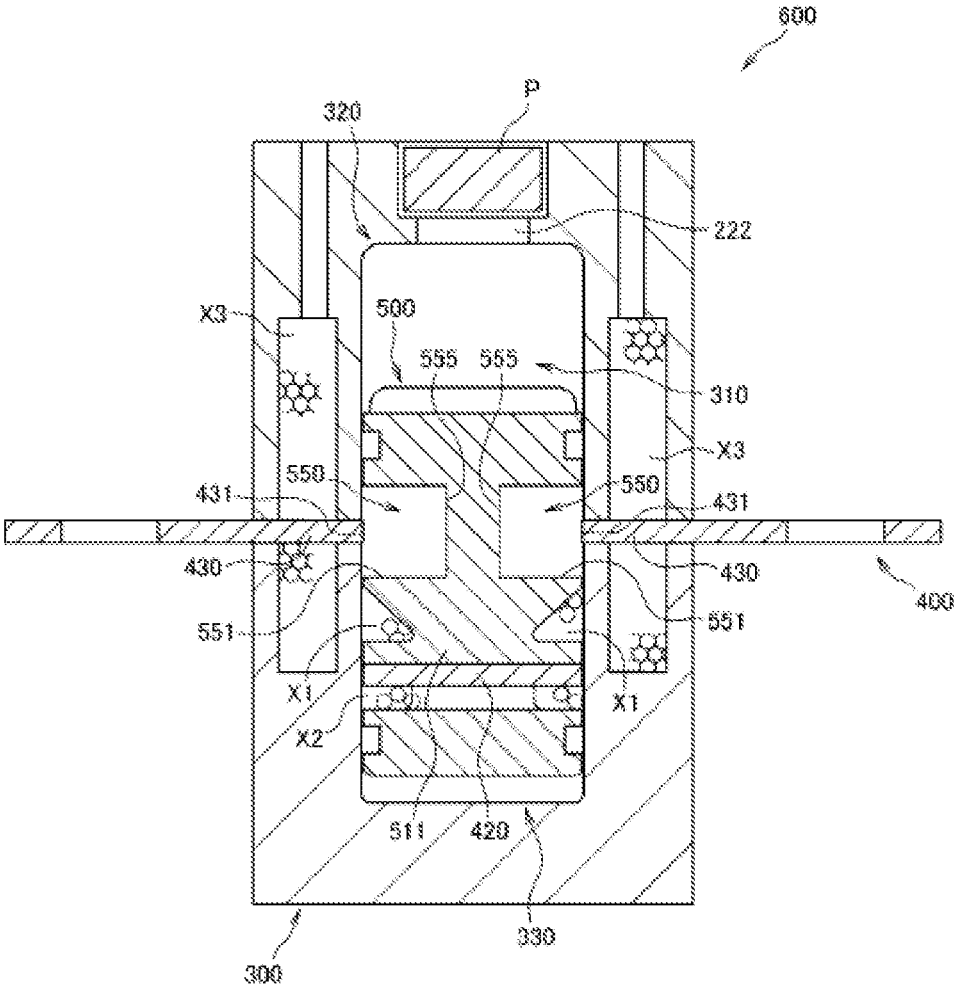
FIG. 8 is a cross-sectional view showing a state where the moving body further moves from the state shown in FIG. 7.

Further, the separation piece 420 of the cut portion 400 is accommodated by being inserted through the inside of the moving body 500, and the main body portions 430 of the cut portion 400 are inserted and accommodated inside the third arc extinguishing spaces X3. The second arc extinguishing space X2 is arranged on the side opposite to the first arc extinguishing spaces X1 across the cutting member 511. As shown in FIG. 6, a granular arc extinguishing material M is accommodated in the first arc extinguishing spaces X1 and the third arc extinguishing spaces X3. Moreover, since the arc extinguishing material M is filled in the penetrating portion 540 of the moving body 500, the arc extinguishing material M is also to be accommodated in the second arc extinguishing space X2 and the fourth arc extinguishing spaces X4 (see FIG. 3) of the penetrating portion 540. In FIGS. 6 to 8, although the first arc extinguishing spaces X1, the second arc extinguishing space X2, the third arc extinguishing spaces X3, and the fourth arc extinguishing spaces X4 are filled with the arc extinguishing material M, only a part of the arc extinguishing material M is shown on the drawing for the sake of visibility, Although the arc extinguishing material M is accommodated in the first arc extinguishing spaces X1, the present disclosure is not limited to this, and the arc extinguishing material M may not be accommodated. The first arc extinguishing spaces X1 are spaces that are recessed inward, and arcs generated from the end portions 431 of the main body portions 430 are released into the first arc extinguishing spaces X1 as will be described later. Then, the arcs consume energy as they travel through the air in the first arc extinguishing spaces X1, and are eventually extinguished. Therefore, even if the arc extinguishing material M is not accommodated in the first arc extinguishing spaces X1, the first arc extinguishing spaces X1 can sufficiently extinguish the arcs. Similarly, although the arc extinguishing material M is accommodated in the second arc extinguishing space X2 and the fourth arc extinguishing spaces X4, the present disclosure is not limited to this, and the arc extinguishing material M may not be accommodated.

Furthermore, when the arc extinguishing material M is accommodated in the first arc extinguishing spaces X1, the second arc extinguishing space X2, the third arc extinguishing spaces X3, or the fourth arc extinguishing spaces X4, the arc extinguishing material M is not limited to a granular solid arc extinguishing material such as silica sand, and a gaseous arc extinguishing material that can effectively extinguish an arc such as nitrogen gas may be filled in each space.

Next, a usage mode of the electric circuit breaker 600 according to the first embodiment of the present disclosure will be described with reference to FIG. 7. FIG. 7 is a cross-sectional view showing a state where the moving body 500 moves from the state shown in FIG. 6. As shown in FIG. 7, when an abnormality such as an overcurrent flowing in the electric circuit is detected, an abnormality signal is input to the power source P, and the explosive powder in the power source P explodes. Then, the air pressure due to the explosion is instantaneously transmitted to the upper surface 560 of the moving body 500 via the communication hole 222. Then, due to this air pressure, the moving body 500 is swiftly fused from the first end portion 320 toward the second end portion 330, and instantaneously moves inside the cylindrical portion 310 toward the second end portion 330.

Then, the cutting member 511 of the moving body 500 cuts the separation piece 420 and separate it from the main body portions 430 by the force of pushing out the moving body 500 toward the second end portion 330. Then, the separation piece 420 moves toward the second end portion 330 together with the moving body 500, and separates from the main body portions 430. Further, as shown in FIG. 7, when the moving body 500 moves inside the cylindrical portion 310 toward the second end portion 330, the first arc extinguishing spaces X1 formed above and adjacent to the cutting member 511 move up to the positions facing the main body portions 430. Therefore, the first arc extinguishing spaces X1 are each configured to be located between the separation piece 420 and the main body portion 430 immediately after the cutting member 511 of the moving body 500 cuts the separation piece 420. Then, immediately after the cutting member 511 of the moving body 500 cuts the separation piece 420, since the physical distance between the separation piece 420 and the main body portion 430 is short. Therefore, an arc may be generated between the separation piece 420 and the end portion 431 of the main body portion 430 which is the boundary with the separation piece 420. However, as shown in FIG. 7, the arc generated from the end portion 431 of the main body portion 430 is released to the first arc extinguishing space X1 located between the separation piece 420 and the main body portion 430, and is extinguished. Further, since the arc extinguishing material M is accommodated in the first arc extinguishing spaces X1, the arc can be extinguished more effectively, Next, a state where the moving body 500 further moves toward the second end portion 330 will be described with reference to FIG. 8. FIG. 8 is a cross-sectional view showing a state where the moving body 500 further moves from the state shown in FIG. 7. As shown in FIG. 8, when the moving body 500 moves inside the cylindrical portion 310 toward the second end portion 330, the insulating spaces 550 formed above the first arc extinguishing spaces X1 move up to positions facing and adjacent to the main body portions 430. Even if a high voltage is applied between the main body portions 430 on both sides and arcs are generated from the end portions 431 of the main body portions 430, the arcs are confined in the insulating spaces 550. The arcs generated between the main body portions 430 on both sides are confined in the insulating spaces 550 and insulated from each other, so that it is possible to prevent the arcs from connecting between the main body portions 430 on both sides and causing a current to flow in the electric circuit. The description that the arcs are confined in the insulating spaces 550 and insulated from each other specifically refers to a state where the insulating spaces 550 are dents (see FIG. 3) each surrounded by the lower wall 551, the side wall 552, the side wall 553, the upper wall 554, and the rear wall 555, and hence the arc generated from the end portion 431 of the main body portion 430 on one side is blocked from traveling by the insulating space 550 and cannot travel toward the main body portion 430 on an opposite side.

It is desirable that the arc extinguishing material M be not accommodated in the insulating spaces 550. If the arc extinguishing material M is accommodated in the insulating spaces 550, the arc extinguishing material M may be exposed to high temperature and carbonized by the arcs generated from the main body portion 430. Then, the carbonized portion becomes a path through which an electric current can flow, and the arc easily leaks from the insulating space 550. Then, the arc leaking from the insulating space 550 may travel along the outer surface 530 of the moving body 500 and may be connected to the arc generated from the main body portion 430 on the opposite side. Therefore, it is desirable not to accommodate the arc extinguishing material M in the insulating spaces 550. Further, the insulating spaces 550 may contain a material that is not carbonized by an arc.

As described above, according to the electric circuit breaker 600 of the present disclosure, the moving body 500 itself includes the cutting member 511 that cuts the cut portion 400 and the first arc extinguishing spaces X1, and the first arc extinguishing spaces X1 are each configured to be located between the separation piece 420 that is cut and separated and the main body portion 430 that remains in the housing 300 without being separated immediately after the cutting member 511 cuts the separation piece 420 and cut off the electric circuit. Therefore, immediately after the electric circuit is cut off, the arcs generated from the main body portions 430 can be released into the first arc extinguishing spaces X1 and extinguished.

Furthermore, when the arc extinguishing material M is accommodated in the first arc extinguishing spaces X1, the arcs generated from the main body portions 430 can be extinguished more effectively.

Figure 23:
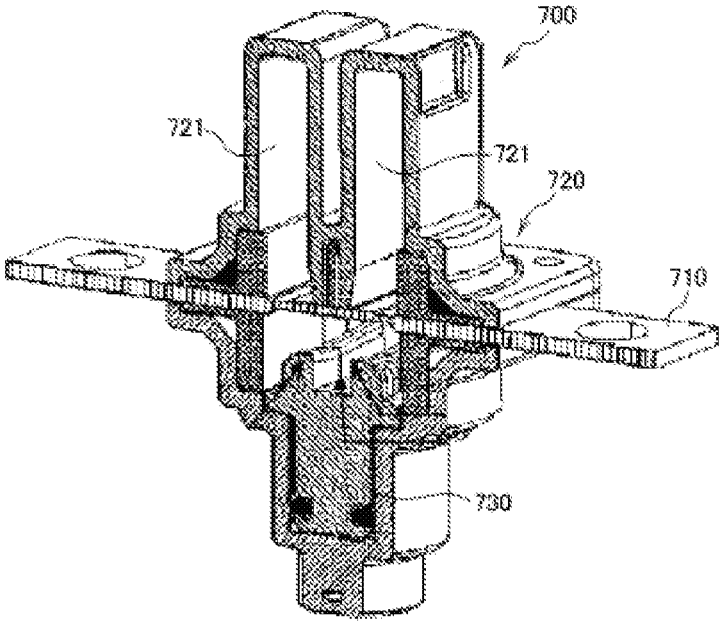
FIG. 23 is a cross-sectional view of a conventional electric circuit breaker.

In the prior art shown in FIG. 23, in order to extinguish an arc, it is also conceivable to enclose a granular solid arc extinguishing material in cutting chambers 721. However, if the arc extinguishing material is enclosed in the cutting chambers 721, it may disturb a punching operation of a punch 730, so that it is difficult to fill the arc extinguishing material in the cutting chambers 721. However, in the present disclosure, unlike the prior art, the arc extinguishing material M can be accommodated in the moving body 500 itself together with the cutting member 511 instead of in the cylindrical portion 310, so that the operation of the moving body 500 that moves inside the cylindrical portion 310 and cuts the separation piece 420 is not disturbed. Further, since the separation piece 420 is accommodated in the moving body 500 and moves together with the moving body 500, there is no risk of disturbing the punching operation of the punch unlike the prior art. Since the arc extinguishing material M and the separation piece 420 are both accommodated in the moving body 500 and move together with the moving body 500, a large amount of the arc extinguishing material M can be accommodated in the moving body 500 unlike the prior art. Furthermore, since the first arc extinguishing spaces X1 can be expanded according to the volume inside the moving body 500, a large amount of the arc extinguishing material M can be accommodated and the arc extinguishing performance is extremely high.

Further, according to the electric circuit breaker 600 of the present disclosure, the insulating spaces 550 are configured to face the main body portions 430 of the cut portion 400 that remain in the housing 300 after the moving body 500 further moves. Thus, even if a high voltage is applied to the main body portions 430 on both sides and arcs are generated from the main body portions 430, the arcs are confined in the insulating spaces 550 and insulated from each other, so that it is possible to prevent the arcs from connecting between the main body portions 430 and causing a current to flow in the electric circuit.

Further, according to the electric circuit breaker 600 of the present disclosure, since the second arc extinguishing space X2 are provided on the side opposite to the first arc extinguishing spaces X1 across the cutting member 511, the arcs traveling from the separation piece 420 toward the second end portion 330 are released into the second arc extinguishing space X2 and extinguished. Furthermore, when the arc extinguishing material M is accommodated in the second arc extinguishing space X2, the arcs can be extinguished more effectively. Further, since the second arc extinguishing space X2 is located on the lower surface side of the separation piece 420, the arc generated in the separation piece 420 is extinguished over a wide range by the arc extinguishing material M in the second arc extinguishing space X2.

Furthermore, according to the electric circuit breaker 600 of the present disclosure, since the main body portions 430 of the cut portion 400 are inserted and accommodated in the third arc extinguishing spaces X3, the arcs generated from the main body portions 430 can be extinguished by the arc extinguishing material M in the third arc extinguishing spaces X3. In particular, the arcs generated between the separation piece 420 and the main body portions 430 can be extinguished by the first arc extinguishing spaces X1, but in the case of enhancing the arc extinguishing performance, it is required to expand the first arc extinguishing spaces X1 to increase the arc extinguishing areas. However, if the first arc extinguishing spaces X1 are expanded, the moving body 500 including the first arc extinguishing spaces X1 and the structure around the cylindrical portion 310 that moves the moving body 500 also become large. However, it is desirable that the drive parts such as the cylindrical portion 310 and the moving body 500 be made as small as possible in view of the performance and safety of the electric circuit breaker 600. Therefore, by providing the third arc extinguishing spaces X3 that accommodate the main body portions 430 of the cut portion 400 outside the cylindrical portion 310 that moves the moving body 500, the extinguishing performance of the arcs generated from the main body portions 430 is improved without increasing the sizes of the cylindrical portion 310 and the moving body 500.

In the first embodiment shown in FIG. 1 to FIG. 8, the insulating spaces 550 are provided at positions above and adjacent to the first arc extinguishing spaces X1, but the present disclosure is not limited to this, and the insulating spaces 550 may not be provided. In that case, the first arc extinguishing spaces X1 are extended to the positions of the insulating spaces 550. The configuration will be described later in more detail with reference to FIGS. 10 to 13.

Second Embodiment

Figure 9A:
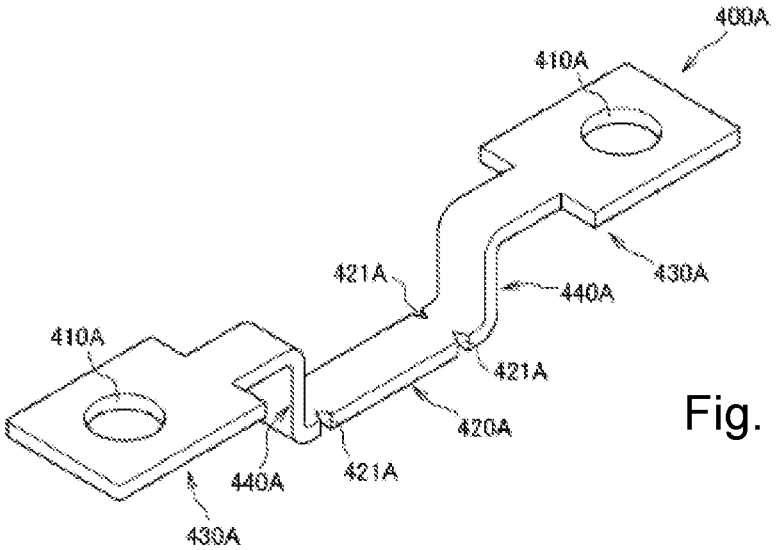
FIG. 9(*a*) is an overall perspective view of a cut portion of an electric circuit breaker according to a second embodiment of the present disclosure, and FIG. 9(*b*) is a cross-sectional view of the electric circuit breaker.
Figure 9B:
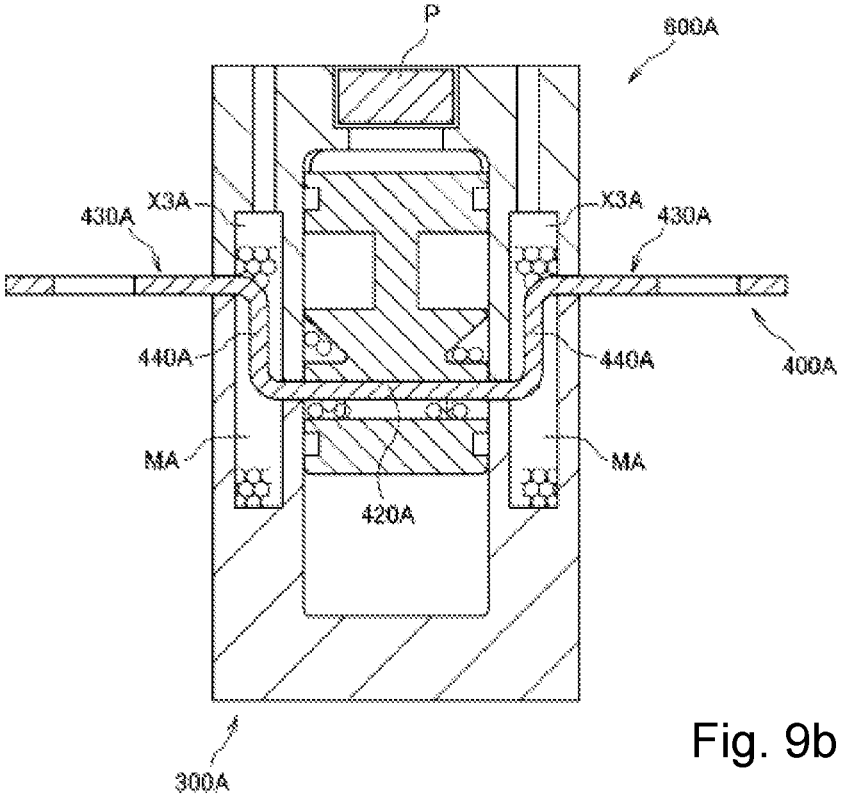

Next, an electric circuit breaker 600A according to a second embodiment of the present disclosure will be described with reference to FIG. 9. FIG. 9(*a*) is an overall perspective view of a cut portion 400A of the electric circuit breaker 600A according to the second embodiment of the present disclosure, and FIG. 9(*b*) is a cross-sectional view of the electric circuit breaker 600A according to the second embodiment in a manner similar to the cross-sectional view of the electric circuit breaker 600 according to the first embodiment shown in FIG. 8. Further, the configuration of the electric circuit breaker 600A according to the second embodiment is basically the same as the configuration of the electric circuit breaker 600 according to the first embodiment, except for the configuration of the cut portion 400A, and hence description of the same configurations will be omitted.

As shown in FIG. 9, the cut portion 400A of the electric circuit breaker 600A includes a separation piece 420A at the center and main body portions 430A on both sides of the separation piece 420A. Further, a part of each of the main body portions 430A is a bent portion 440A that is bent so as to rise from the separation piece 420A. As shown in FIG. 9(*b*), the bent portions 440A of the cut portion 400A are bent in third arc extinguishing spaces X3A of a housing 300A along the up-down direction in which the third arc extinguishing spaces X3A extend. Therefore, the contact area between the bent portion 440A and an arc extinguishing material MA in the third arc extinguishing space X3A is increased as compared to the contact area between the main body portion 430 and the arc extinguishing material M that are linearly inserted through the third arc extinguishing space X3 shown in FIG. 6. As a result, in the electric circuit breaker 600A, the arc extinguishing performance for extinguishing the arcs generated from the main body portions 430A is improved.

In addition, in FIG. 9, the bent portions 440A of the cut portion 400A have a shape that rises from the separation piece 420A and bends along the up-down direction in which the third arc extinguishing spaces X3A extend, but the present disclosure is not limited to this. The bent portions 440A may have any shape as long as it bends in the third arc extinguishing spaces X3A so as to increase the contact areas with the arc extinguishing material MA.

Third Embodiment

Figure 10A:
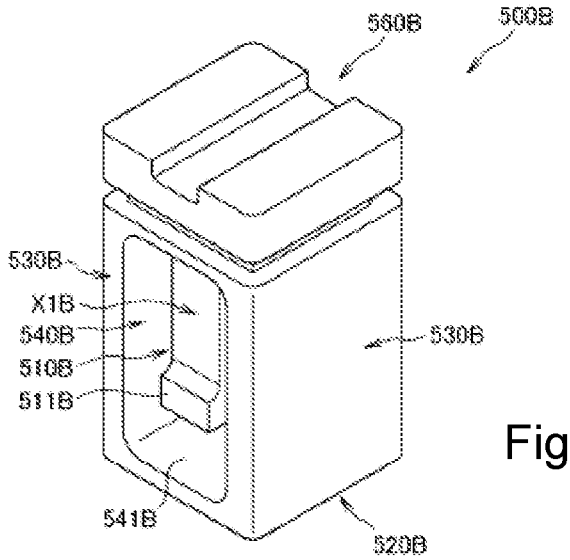
FIG. 10(*a*) is a perspective view of a moving body of an electric circuit breaker according to a third embodiment of the present disclosure, FIG. 10(*b*) is a front view of the moving body, and FIG. 10(*c*) is a side view of the moving body.
Figure 10B:
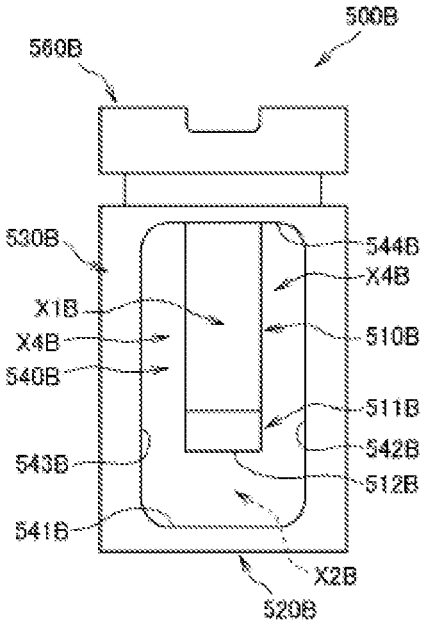
Figure 10C:
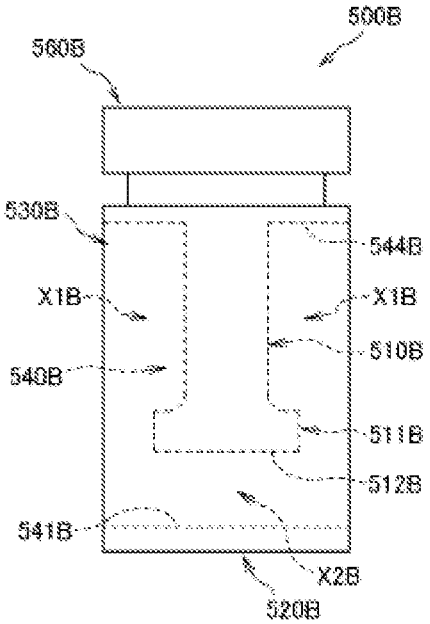

Next, an electric circuit breaker 600B according to a third embodiment of the present disclosure will be described with reference to FIGS. 10 to 13. FIG. 10(*a*) is a perspective view of a moving body 500B of the electric circuit breaker 600B according to the third embodiment of the present disclosure, FIG. 10(*b*) is a front view of the moving body 500B, and FIG. 10(*c*) is a side view of the moving body 500B. Further, the configuration of the electric circuit breaker 600E according to the third embodiment is basically the same as the configuration of the electric circuit breaker 600 according to the first embodiment except that the moving body 500B does not includes the insulating space, and a housing 300B does not include a third arc extinguishing spaces X3, and hence detailed description of the same configurations will be omitted.

As shown in FIG. 10, the moving body 500B is a substantially rectangular parallelepiped made of synthetic resin and having an upper surface 560B and a lower surface 520B. Further, from the upper surface 560B side to the lower surface 520B side of the moving body 500B, there is provided a penetrating portion 540B which penetrates the moving body 500B from one part of the outer surface 530B to another part of the outer surface 530B on the opposite side, that is, from the front surface to the back surface of the moving body 500B, and the penetrating portion 540B is surrounded by a lower wall 541B, a side wall 542B, a side wall 543B, and an upper wall 544B.

Furthermore, inside the penetrating portion 540B, a protruding portion 510B protrudes from the upper wall 544B toward the lower wall 541B. A cutting member 511B are formed on the tip side of the protruding portion 510B, and the lower surface of the cutting member 511B is a flat abutment surface 512B that comes into abutment against a surface of a separation piece 420B of a cut portion 400B. Further, first arc extinguishing spaces X1B that are recessed inward from the outer surface 530B are formed on the root side of the protruding portion 510B.

The first arc extinguishing spaces X1B is a long space extending from the cutting member 511B toward the upper surface 560B, and an arc extinguishing material can be optionally accommodated inside the space. Further, the arc extinguishing material can be accommodated in a second arc extinguishing space X2B between the cutting member 511B and the lower wall 541B. Similarly, an arc extinguishing material can be accommodated in a fourth arc extinguishing space X4B between the protruding portion 510B and each of the side wall 542B and the side wall 543B. Therefore, the periphery of the separation piece 420B of the cut portion 400B arranged so as to come into abutment against the cutting members 511 can be surrounded by the arc extinguishing material. Although an arc extinguishing material MB is accommodated in the first arc extinguishing spaces X1B, the present disclosure is not limited to this, and the arc extinguishing material MB may not be accommodated. Similarly, although the arc extinguishing material MB is accommodated in the second arc extinguishing space X2B and the fourth arc extinguishing spaces X4B, the present disclosure is not limited to this, and the arc extinguishing material MB may not be accommodated.

Figure 11:
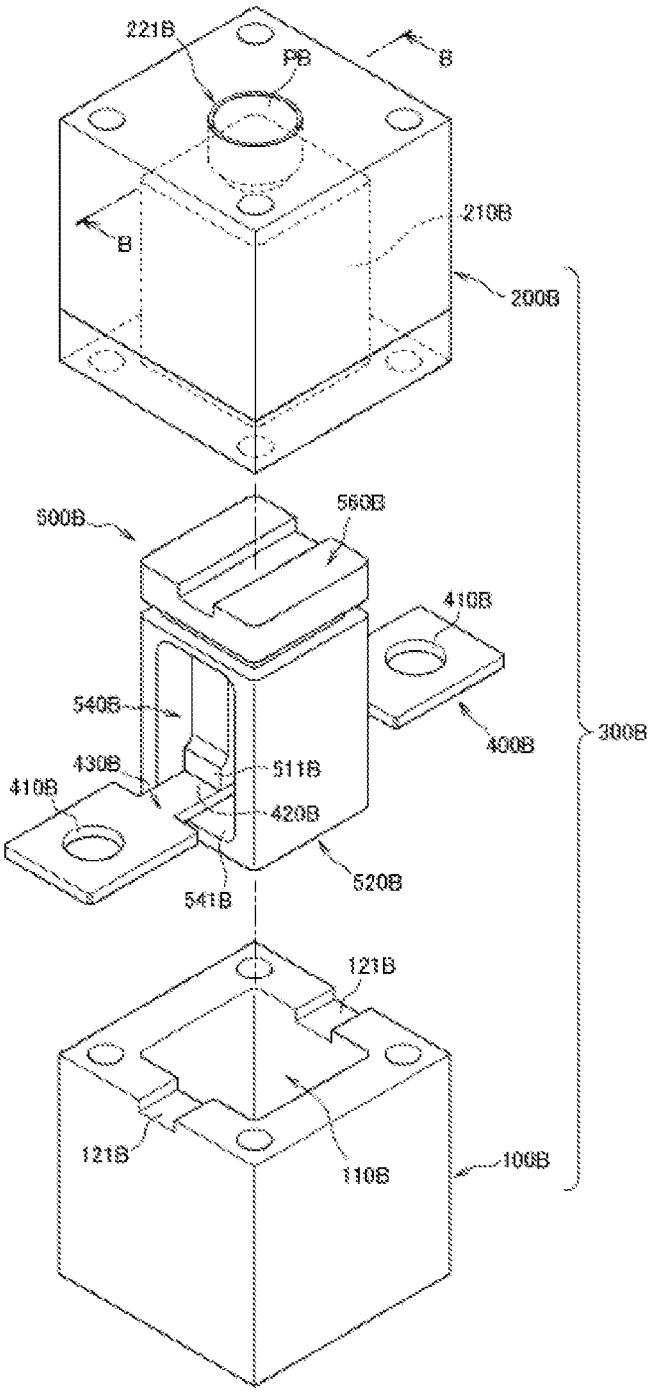
FIG. 11 is an exploded perspective view of the electric circuit breaker according to the third embodiment of the present disclosure.

Next, how to assemble the electric circuit breaker 600B of the present disclosure will be described with reference to FIG. 11. FIG. 11 shows an exploded perspective view of the electric circuit breaker 600B.

First, in the penetrating portion 540E of the moving body 500B, main body portions 430B of the cut portion 400B are inserted between the cutting member 511 and the lower wall 541B, and the cut portion 400B is inserted up to a position where the separation piece 420B of the cut portion 400B faces the cutting member 511B of the moving body 500B. Then, as shown in FIG. 11, the separation piece 420B of the cut portion 400E is inserted and accommodated inside the moving body 500B, Next, the moving body 500B is inserted from the lower surface 520B side into a lower cylindrical portion 110B of a lower housing 100B. Then, the main body portions 430B of the cut portion 400B are placed so as to be fitted into mounting portions 121B of the lower housing 100B, and the moving body 500B is fixed inside the lower cylindrical portion 110B. Next, an upper housing 200B is fitted from above the lower housing 100B so that the upper surface 560B of the moving body 500B is inserted into the upper cylindrical portion 210B of the upper housing 200B. Then, by connecting and fixing the upper housing 200B and the lower housing 100B to each other, the housing 300B including the lower housing 100B and the upper housing 200B is assembled under a state of accommodating the cut portion 400B and the moving body 500B therein, Further, a power source PB is mounted to a power source accommodating portion 221B of the upper housing 200B. The lower cylindrical portion 110B of the lower housing 100B and the upper cylindrical portion 210B of the upper housing 200B have a substantially quadrangular cylindrical shape in cross section according to the shape of the moving body 500B so that the moving body 500B can be accommodated and slid therein. Further, a third arc extinguishing space is not formed around the lower cylindrical portion 110B and the upper cylindrical portion 210B, but may be formed as needed.

Figure 12:
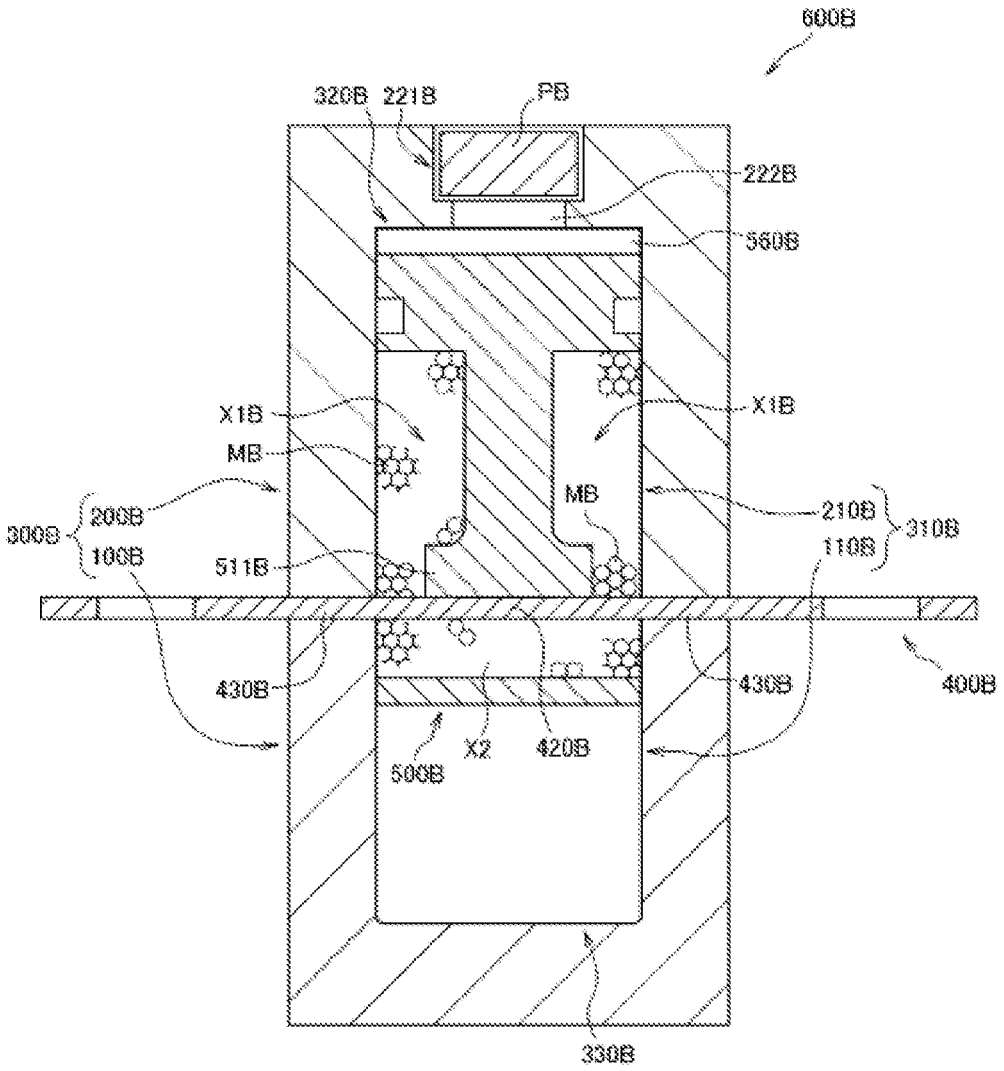
FIG. 12 is a cross-sectional view taken along the line B-B in a state where the electric circuit breaker shown in FIG. 11 is assembled.

Next, the internal structure of the electric circuit breaker 600B according to the third embodiment of the present disclosure will be described with reference to FIG. 12. FIG. 12 is a cross-sectional view taken along the line B-B in a state where the electric circuit breaker 600B shown in FIG. 11 is assembled.

As shown in FIG. 12, the moving body 500B is accommodated inside the cylindrical portion 310B composed of the lower cylindrical portion 110B and the upper cylindrical portion 210B which are linearly arranged. The cylindrical portion 310B extends from a first end portion 320B of the housing 300B to a second end portion 330B on a side opposite to the first end portion 320B. Since the moving body 500B is arranged on the first end portion 320B side where the power source PB is arranged, the moving body 500B can move to the second end portion 330B side while cutting and separating the separation piece 420B, as will be described later.

Further, as shown in FIG. 12, the granular arc extinguishing material MB is accommodated in the first arc extinguishing spaces X1B. Moreover, since the arc extinguishing material MB is filled in the penetrating portion 540B of the moving body 500B, the arc extinguishing material M is also to be accommodated in the second arc extinguishing space X2B and the fourth arc extinguishing spaces X4B (see FIG. 10) of the penetrating portion 540B.

Figure 13:
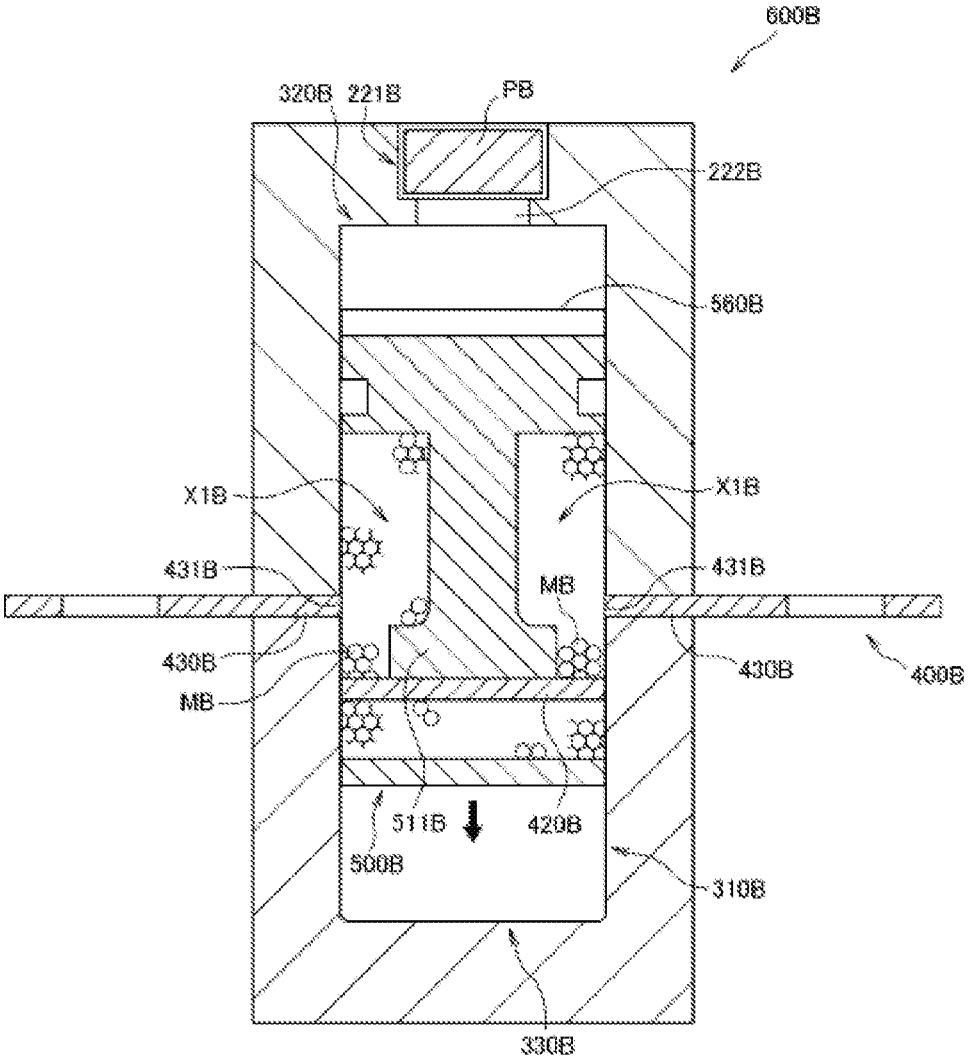
FIG. 13 is a cross-sectional view showing a state where the moving body moves from the state shown in FIG. 12.

Next, a usage mode of the electric circuit breaker 600B according to the third embodiment of the present disclosure will be described with reference to FIG. 13. FIG. 13 is a cross-sectional view showing a state where the moving body 500B moves from the state shown in FIG. 12. As shown in FIG. 13, when an abnormality such as an overcurrent flowing in the electric circuit is detected, an abnormality signal is input to the power source PB, and the explosive powder in the power source PB explodes. Then, the air pressure due to the explosion is instantaneously transmitted to the upper surface 560B of the moving body 500B via a communication hole 222B, and the moving body 500B is swiftly fused from the first end portion 320B toward the second end portion 330B, and instantaneously moves inside the cylindrical portion 310B toward the second end portion 330B.

Then, the cutting member 511B of the moving body 500B cuts the separation piece 420B and separate it from the main body portions 430B by the force of pushing out the moving body 500B toward the second end portion 330B. Then, the separation piece 420B moves toward the second end portion 330B together with the moving body 500B, and separates from the main body portions 430B. Further, as shown in FIG. 13, when the moving body 566E moves inside the cylindrical portion 316E toward the second end portion 330B, the first arc extinguishing spaces X1B formed adjacent to the cutting member 511B move up to the positions facing the main body portions 430B. Therefore, the first arc extinguishing spaces X1B are each configured to be located between the separation piece 420B and the main body portion 430B immediately after the cutting member 511B of the moving body 500B cuts the separation piece 420B. Then, even if arcs are generated between the separation piece 420B and the end portions 431B of the main body portions 430B immediately after the cutting member 511B of the moving body 500B cuts the separation piece 420B, the arcs generated from the end portions 431B of the main body portions 430B are released into the first arc extinguishing spaces X1B located between the separation piece 420B and the main body portions 430B, and are extinguished. Further, since the arc extinguishing material MB is accommodated in the first arc extinguishing spaces X1B, the arc can be extinguished more effectively.

As described above, according to the electric circuit breaker 600B of the present disclosure, the moving body 500B itself includes the cutting member 511B that cuts the cut portion 400B and the first arc extinguishing spaces X1B, and the first arc extinguishing spaces X1B are each configured to be located between the separation piece 420B that is cut and separated and the main body portion 430B that remains in the housing 300B without being separated immediately after the cutting member 511B cuts the separation piece 420B and cut off the electric circuit. Therefore, immediately after the electric circuit is cut off, the arcs generated from the main body portions 430B can be released into the first arc extinguishing spaces X1B and extinguished.

Furthermore, when the arc extinguishing material M is accommodated in the first arc extinguishing spaces X1B, the arcs generated from the main body portions 430E can be extinguished more effectively.

In the prior art shown in FIG. 23, in order to extinguish an arc, it is also conceivable to enclose a granular solid arc extinguishing material in cutting chambers 721. However, if the arc extinguishing material is enclosed in the cutting chambers 721, it may disturb a punching operation of a punch 730, so that it is difficult to fill the arc extinguishing material in the cutting chambers 721. However, in the present disclosure, unlike the prior art, the arc extinguishing material MB can be accommodated in the moving body 500B itself together with the cutting member 511B instead of in the cylindrical portion 310, so that the operation of the moving body 500E that moves inside the cylindrical portion 310E and cuts the separation piece 420B is not disturbed. Further, since the separation piece 420E is accommodated in the moving body 500B and moves together with the moving body 500B there is no risk of disturbing the punching operation of the punch unlike the prior art. Since the arc extinguishing material MB and the separation piece 420B are both accommodated in the moving body 500B and move together with the moving body 500B, a large amount of the arc extinguishing material MB can be accommodated in the moving body 500B unlike the prior art. Furthermore, since the first arc extinguishing spaces X1B can be expanded according to the volume inside the moving body 500B, a large amount of the arc extinguishing material MB can be accommodated and the arc extinguishing performance is extremely high.

Further, since the first arc extinguishing spaces X1B extend in a long shape upward from the cutting member 511B, a large amount of the arc extinguishing material MB can be accommodated therein. Further, even in the process in which the moving body 500B moves toward the second end portion 330B on the lower side, the first arc extinguishing spaces X1B extending vertically in a long shape can be reliably positioned between the separation piece 420B and the main body portions 430B.

Fourth Embodiment

Next, an electric circuit breaker 600C according to a fourth embodiment of the present disclosure will be described with reference to FIGS. 14 to 18. In the electric circuit breaker 600C according to the fourth embodiment of the present disclosure, the bent portions 440A can be used together, like the cut portion 400A of the electric circuit breaker 600A according to the second embodiment shown in FIG. 9.

First, in the electric circuit breaker 600 according to the first embodiment, as shown in FIG. 7, the cut portion 400, which is a conductor electrically connected to the electric circuit, is physically cut to cut off the electric circuit. For example, when a relatively low abnormal current flows in the electric circuit, if the electric circuit is to be cut off, the cut portion 400 may be physically cut by the electric circuit breaker 600 according to the first embodiment. On the other hand, if a relatively high abnormal current flows in the electric circuit, if the electric circuit is to be cut off, a fuse of a specified rating is connected in the electric circuit and the fuse is fused due to the abnormal current so that the electric circuit may be cut off. As described above, in the electric circuit, the electric circuit breaker 600 according to the first embodiment and the fuse are connected in series. If a relatively low abnormal current flows, the electric circuit breaker 600 cuts off the electric circuit, and if a relatively high abnormal current flows, the fuse is fused and the electric circuit is cut off. Even if the electric circuit breaker 600 does not operate normally and the electric circuit cannot be cut off, the fuse connected in series to the electric circuit breaker 600 will be eventually fused, so that the electric circuit can be reliably protected.

However, in order to deal with each of the predetermined abnormal currents, if the cut portion 400 to be cut by the electric circuit breaker 600 according to the first embodiment and the fuse which is fused by the predetermined abnormal current are connected in series to the electric circuit, a space for arranging both the electric circuit breaker 600 and the fuse in series is required in the electric circuit, which causes a problem that the manufacturing cost of the electric circuit and peripheral members increases and the installation space becomes bulky.

Therefore, as will be described later in detail, the electric circuit breaker 600C according to the fourth embodiment of the present disclosure can solve the above problem. The electric circuit breaker 600C according to the fourth embodiment of the present disclosure also solves the problem solved by the disclosure of the first to third embodiments "effectively extinguishing the arc generated immediately after the electric circuit is cut off" at the same time.

Now, in FIGS. 14 to 18 below, the electric circuit breaker 600C according to the fourth embodiment of the present disclosure will be specifically described. Note that FIG. 14(*a*) is a perspective view of a moving body 500C of the electric circuit breaker 600C according to the fourth embodiment of the present disclosure, FIG. 14(*b*) is a front view of the moving body 500C, and FIG. 14(*c*) is a side view of the moving body 500C. Further, since the configuration of the electric circuit breaker 600C according to the fourth embodiment is different from the configuration of the electric circuit breaker 600 according to the first embodiment in the configuration of the moving body 500C and the configuration of a cut portion 400C, but other configurations are basically the same as those of the electric circuit breaker 600 according to the first embodiment, and hence detailed description of the same configurations will be omitted.

Figure 14A:
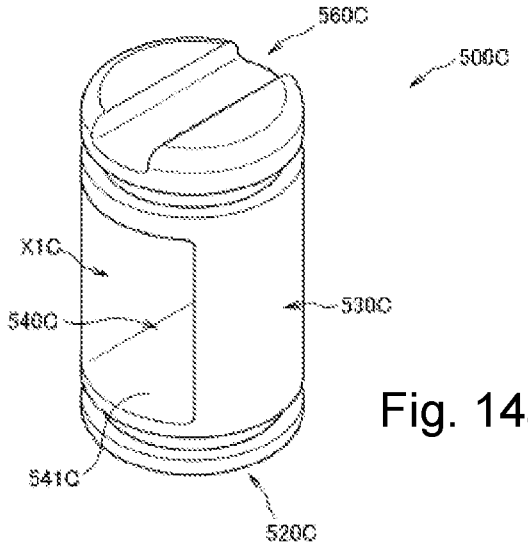
FIG. 14(*a*) is a perspective view of a moving body of and electric circuit breaker according to a fourth embodiment of the present disclosure, FIG. 14(*b*) is a front view of the moving body, and FIG. 14(*c*) is a side view of the moving body.
Figure 14B:
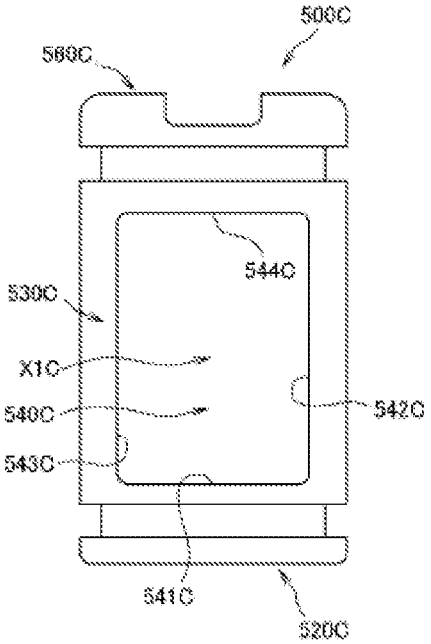
Figure 14C:
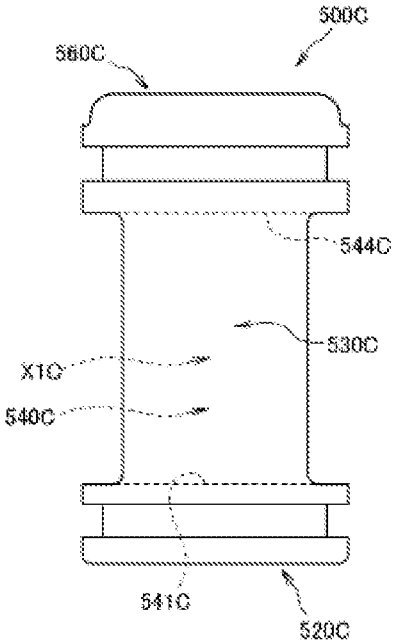

First, as shown in FIG. 14, the moving body 500C is a substantially columnar body made of synthetic resin having an upper surface 560C and a lower surface 520C. The outer diameter of the moving body 500C is equal to or smaller than the inner diameter of the cylindrical portion 310C of the housing 300, and an outer surface 530C of the moving body 500C is a smooth surface corresponding to the inner surface shape of the cylindrical portion 310C, so that the moving body 500C can slide the inside of the cylindrical portion 310C smoothly without gaps.

Further, at substantially the center of the moving body 500C, there is provided a penetrating portion 540C which penetrates the moving body 500C from one part of the outer surface 530C to another part of the outer surface 530C on the opposite side, that is, from the front surface to the back surface of the moving body 500C, and the penetrating portion 540C is surrounded by a lower wall 541C, a side wall 542C, a side wall 543C, and an upper wall 544C. A space surrounded by the lower wall 541C, the side wall 542C, the side wall 543C, and the upper wall 544C and recessed inward from the outer surface 530C is a first arc extinguishing space X1C. Then, in the first arc extinguishing space X1C, a separation piece 420C of the cut portion 400C described later can be inserted and accommodated. Further, in the first arc extinguishing space X1C, since an arc extinguishing material described later is filled, the periphery of the separation piece 420C of the cut portion 400C accommodated in the first arc extinguishing space X1C can be completely surrounded by the arc extinguishing material.

The moving body 500C is not provided with a cutting member for cutting the separation piece 420C of the cut portion 400C. Further, the moving body 500C has a columnar shape made of synthetic resin, but is not limited to this, and other materials may be used to form any shape as long as it has high insulation and strength that can withstand use.

Figure 15A:
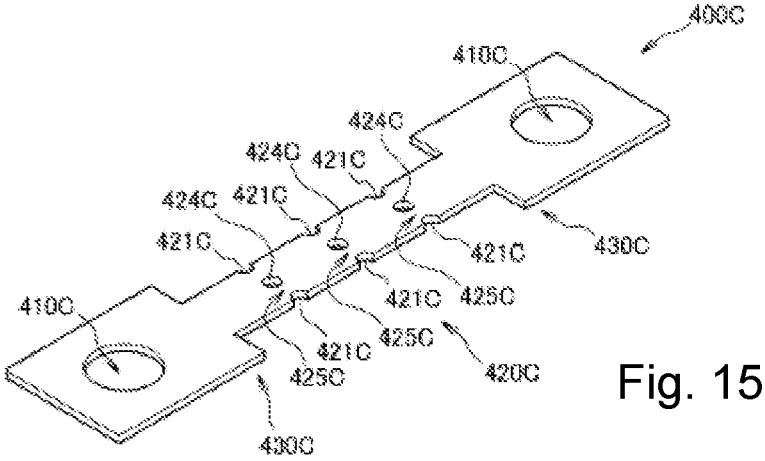
FIG. 15(*a*) is a perspective view of a cut portion of the electric circuit breaker according to the fourth embodiment of the present disclosure, and FIG. 15(*b*) is a plan view of the cut portion.
Figure 15B:
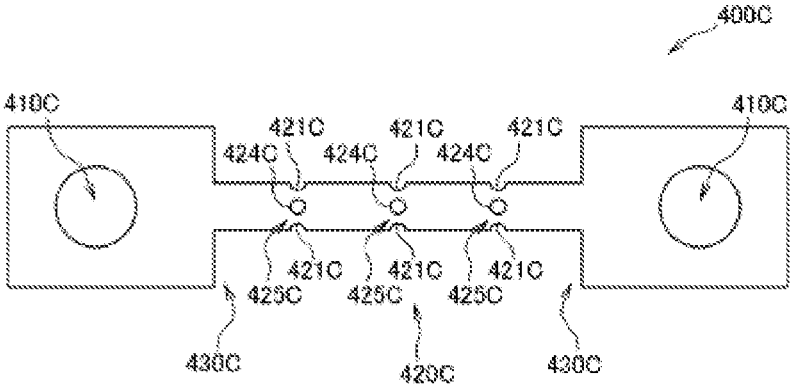

Next, FIG. 15 shows the cut portion 400C that constitutes a part of an electric circuit which is cut off by the electric circuit breaker 600C according to the fourth embodiment of the present disclosure. FIG. 15(*a*) is a perspective view of the cut portion 400C, and FIG. 4(*b*) is a plan view of the cut portion 400C. The cut portion 400C is entirely made of a metal fuse in order to electrically connect to an electric circuit, and includes main body portions 430C for connecting to the electric circuit at both ends, and the separation piece 420C to be cut and separated at substantially the center. Connection holes 410C used for connection to an electric circuit are formed at the end portions of the main body portions 430C. Further, notches 421C and through holes 424C are provided at the center and both ends of the separation piece 420, and fusing portions 425C having a locally narrowed width are formed. The fusing portions 425C are portions that generate heat and are fused when an abnormal current flows in the electric circuit.

The cut portion 400C having the fuse function shown in FIG. 15 is thinner than the cut portion 400 not having the fuse function shown in FIG. 4. By reducing the thickness of the cut portion 400C, the thickness of the fusing portions 425C is also reduced, which facilitates fusing when an abnormal current flows.

Figure 16:
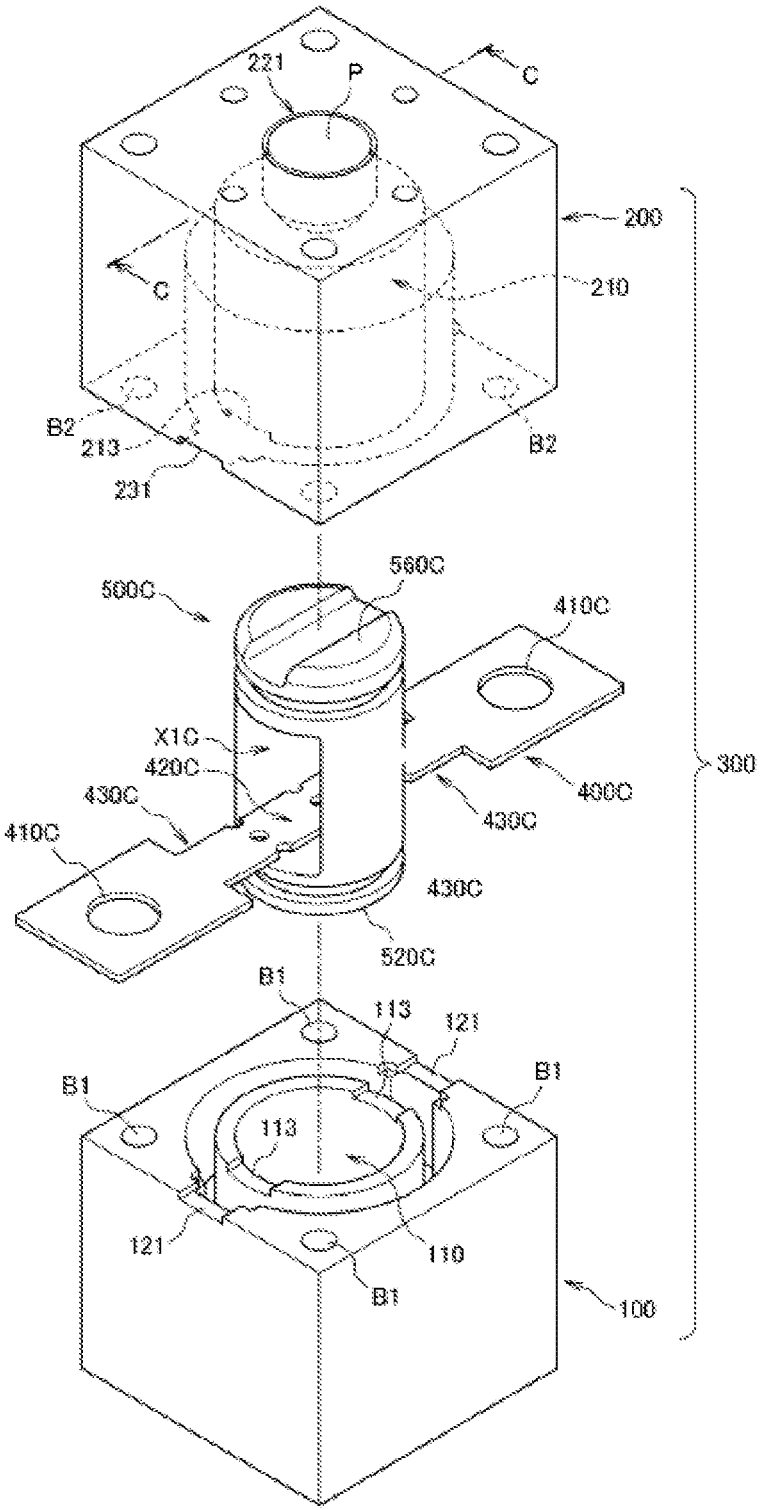
FIG. 16 is an exploded perspective view of the electric circuit breaker according to the fourth embodiment of the present disclosure.

Next, how to assemble the electric circuit breaker 600C according to the fourth embodiment of the present disclosure will be described with reference to FIG. 16. FIG. 16 shows an exploded perspective view of the electric circuit breaker 600C.

First, the main body portions 430C of the cut portion 400C are inserted into the first arc extinguishing space X1C of the moving body 500C, and the cut portion 400C is insert up to a position where the separation piece 420C of the cut portion 400C is accommodated in the first arc extinguishing space X1C of the moving body 500.

Next, the moving body 500C is inserted from the lower surface 520C side into the lower cylindrical portion 110 of the lower housing 100. Then, the main body portions 430C of the cut portion 400C are placed so as to be fitted into the mounting portions 113 and the mounting portions 121 of the lower housing 100, and the moving body 500C is fixed inside the lower cylindrical portion 110. Next, the upper housing 200 is fitted from above the lower housing 100 so that the upper surface 560C of the moving body 500C is inserted into the upper cylindrical portion 210 of the upper housing 200. Then, by pushing the upper housing 200 toward the lower housing 100, the mounting portions 213 and the mounting portions 231 of the upper housing 200 are fitted to the main body portions 430C of the cut portion 400C. The connecting holes B1 and the connecting holes B2 arranged vertically are connected and fixed by a connecting member or the like, so that the housing 300 including the lower housing 100 and the upper housing 200 is assembled under a state of accommodating the cut portion 400C and the moving body 500C therein.

Further, the power source P is mounted to the power source accommodating portion 221 of the upper housing 200. When an abnormality signal is input from the outside when an abnormal current flowing in the electric circuit is detected, the power source P explodes, for example, explosive powder inside the power source P, and the air pressure resulting from the explosion causes the moving body 500C to be instantly pushed out inside the cylindrical portion 310 so as to be moved. The power source P is not limited to a power source using explosive powder as long as it generates power to move the moving body 500C, and other known power sources may be used.

Figure 17:
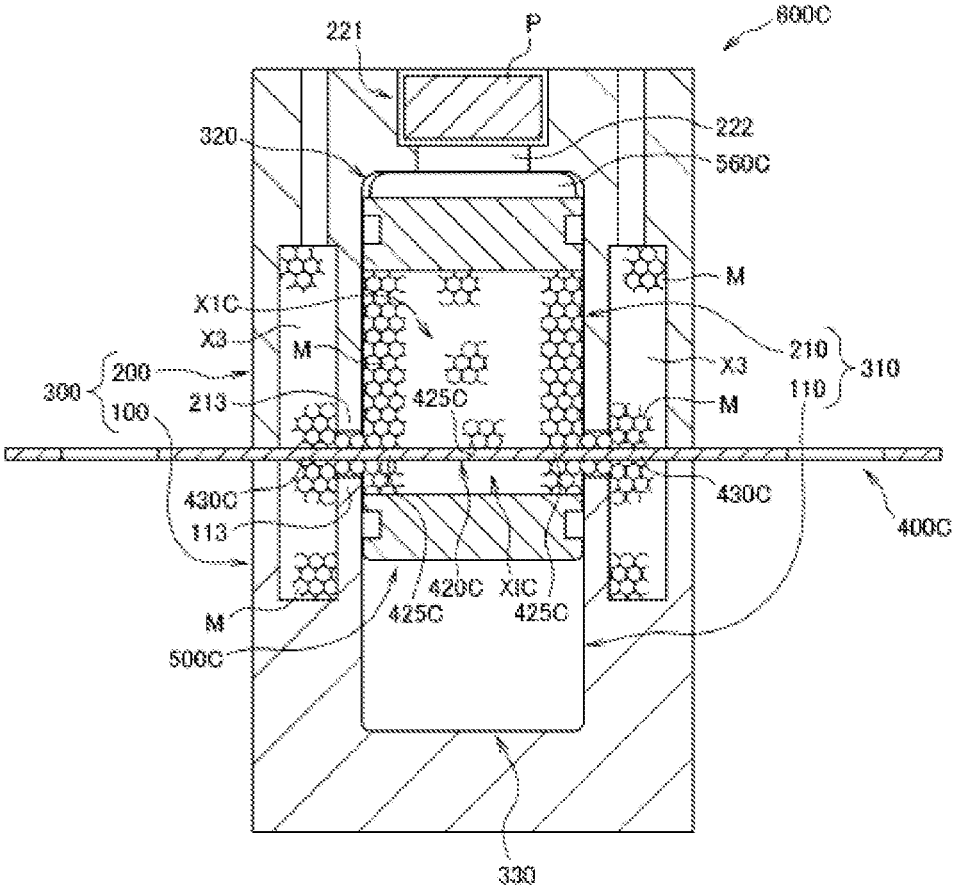
FIG. 17 is a cross-sectional view taken along the line C-C in a state where the electric circuit breaker shown in FIG. 16 is assembled.

Next, the internal structure and the usage mode of the electric circuit breaker 600C according to the fourth embodiment of the present disclosure will be described with reference to FIG. 17. FIG. 17 is a cross-sectional view taken along the line C-C in a state where the electric circuit breaker 600C shown in FIG. 16 is assembled.

As shown in FIG. 17, the moving body 500C is accommodated inside the cylindrical portion 310 composed of the lower cylindrical portion 110 and the upper cylindrical portion 210 which are linearly arranged. The cylindrical portion 310 extends from a first end portion 320 of the housing 300 to a second end portion 330 on a side opposite to the first end portion 320. Since the moving body 500C is arranged on the first end portion 320 side where the power source P is arranged, the second end portion 330 side of the cylindrical portion 310 is hollow. Therefore, as will be described later, the moving body 500C can move toward the second end portion 330 side while cutting and separating the separation piece 420C. In addition, the upper surface 560C of the moving body 500C is adjacent to the power source P mounted inside the power source accommodating portion 221. As will be described later, the air pressure due to the explosion of the explosive powder in the power source P is transmitted to the upper surface 560C of the moving body 500C via the communication hole 222.

Figure 18:
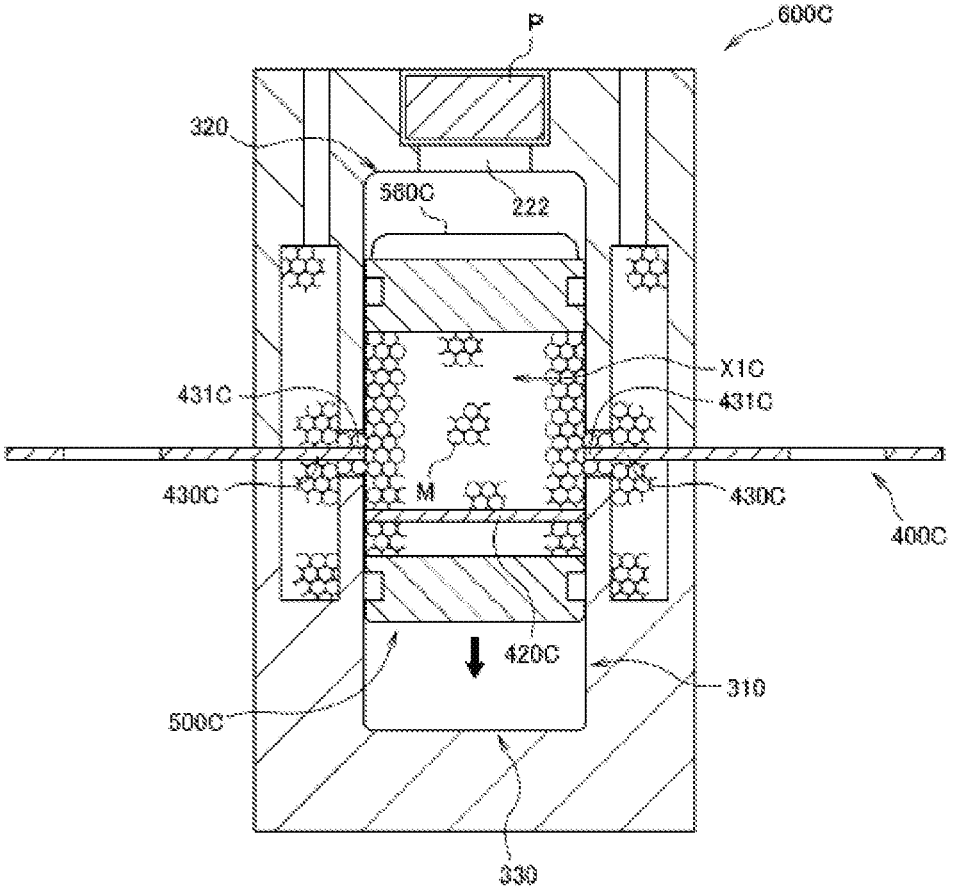
FIG. 18 is a cross-sectional view showing a state where the moving body moves from the state shown in FIG. 17.

As shown in FIG. 17, the granular arc extinguishing material M is accommodated in the first arc extinguishing space X1C and the third arc extinguishing spaces X3. Since the separation piece 420C of the cut portion 400C is accommodated by being inserted through the inside of the first arc extinguishing space X1C of the moving body 500C, the arc extinguishing material M covers the peripheries of the fusing portions 425C of the cut portion 400C. Further, the main body portions 430C of the cut portion 400C are accommodated by being inserted through the insides of the third arc extinguishing spaces X3. In FIGS. 17 and 18, although the entire first arc extinguishing space X1C and the entire third arc extinguishing spaces X3 are filled with the arc extinguishing material M, only a part of the arc extinguishing material M is shown on the drawing for the sake of visibility.

Then, when a relatively high abnormal current flows in the electric circuit, the fusing portions 425C of the cut portion 400C connected to the electric circuit generate heat and are fused. Therefore, the electric circuit is cut off and protected from an overcurrent. Further, even when arcs are generated from the peripheries of the remaining fusing portions 425C during or after the fusing portions 425C of the cut portion 400C are fused, the arcs are effectively extinguished by the arc extinguishing material M in the peripheries of the fusing portions 425C. Further, the cut portion 400C is accommodated in the first arc extinguishing space X1C filled with the arc extinguishing material M, and the cut portion 400C is not held in direct contact with the moving body 500C in the first arc extinguishing space X1C. Therefore, even when an arc is generated from the cut portion 400C, it is possible to prevent the moving body 500C made of synthetic resin from being carbonized.

Further, as shown in FIG. 17, there are slight gaps between the mounting portions 213 of the upper housing 200 and the mounting portions 113 of the lower housing 100, and the arc extinguishing material M can be accommodated in the gaps. In these gaps, the arc extinguishing material M is filled around the main body portions 430C of the cut portion 400C, so that the main body portions 430C are not held in direct contact with the mounting portions 213 of the upper housing 200 and the mounting portions 113 of the lower housing 100. Therefore, even when arcs are generated from the peripheries of the main body portions 430C of the cut portion 400C, the arc extinguishing material M accommodated in the gaps extinguishes the arcs, and the mounting portions 213 of the upper housing 200 and the mounting portions 113 of the lower housing 100 are prevented from being carbonized. Since the arc generation state changes depending on the magnitude of the voltage applied to the cut portion 400C, depending on the arc generation state, gaps may not be provided, and the main body portions 430C of the cut portion 400C may be held in direct contact with the mounting portions 213 of the upper housing 200 and the mounting portions 113 of the lower housing 100.

In this way, when a relatively high abnormal overcurrent flows in the electric circuit, the cut portion 400C constituted by the fuse is fused to cut off the electric circuit. On the other hand, when an overcurrent below the rating of the fuse flows in the electric circuit, for example, when a relatively low abnormal overcurrent flows in the electric circuit, the cut portion 400C constituted by the fuse is not fused. Therefore, as will be described with reference to FIG. 18, the cut portion 400C itself is physically cut by the electric circuit breaker 600C.

FIG. 18 is a cross-sectional view showing a state where the moving body 500C moves from the state shown in FIG. 17. Further, in the above description, when a relatively high abnormal overcurrent flows, the cut portion 400C constituted by the fuse is fused to cut off the electric circuit, and when a relatively low abnormal overcurrent flows, the cut portion 400C itself is physically cut by the electric circuit breaker 600C. However, the present disclosure is not limited to this. By changing the rating of the fuse or the setting of the abnormal signal input to the power source P, when a relatively low abnormal overcurrent flows, the cut portion 400C constituted by the fuse may be fused to cut off the electric circuit, and when a relatively high abnormal overcurrent flows, the cut portion 400C may be physically cut by the electric circuit breaker 600C. Therefore, in the following description, the overcurrent when the cut portion 400C constituted by the fuse is fused is referred to as a predetermined first overcurrent, and the overcurrent when the cut portion 400C itself is physically cut by the electric circuit breaker 600C is referred to as a predetermined second overcurrent. The first overcurrent and the second overcurrent can be set to any values.

As shown in FIG. 18, when an abnormality such as the predetermined second overcurrent flowing in the electric circuit is detected, an abnormality signal is input to the power source P, and the explosive powder in the power source P explodes. Then, the air pressure due to the explosion is instantaneously transmitted to the upper surface 560C of the moving body 500C via the communication hole 222. Then, due to this air pressure, the moving body 500C is swiftly fused from the first end portion 320 toward the second end portion 330, and instantaneously moves inside the cylindrical portion 310 toward the second end portion 330.

Then, the moving body 500C cuts the separation piece 420C and separates it from the main body portions 430C by the force of pushing out the moving body 500C toward the second end portion 330. Specifically, since the arc extinguishing material M is filled inside the first arc extinguishing space X1C, when the moving body 500C moves, the separation piece 420C is also instantly pushed out with a strong force toward the second end portion 330 together with the arc extinguishing material M in the vicinity and is cut from the main body portions 430C. Then, the separation piece 420C moves toward the second end portion 330 together with the moving body 500C, and separates from the main body portions 430C. The cut portion 400C constituted by the fuse is relatively thinly formed because it is fused when an overcurrent flows. Therefore, the separation piece 420C can be sufficiently cut without the cutting member 511 as shown in FIG. 3. Further, the arc extinguishing material M in the first arc extinguishing space X1C is not limited to a granular solid arc extinguishing material such as silica sand, and any arc extinguishing material can be adopted as long as it can transmit, to the separation piece 420C, the force when the moving body 500C moves so that the separation piece 420C can be cut.

Further, as shown in FIG. 18, the first arc extinguishing space X1C is located at a position facing the main body portions 430C even when the moving body 500C moves inside the cylindrical portion 310 toward the second end portion 330. Therefore, the first arc extinguishing space X1C is configured to be located between the separation piece 420C and the main body portions 430C immediately after the moving body 500C cuts the separation piece 420C. Then, immediately after the moving body 500C cuts the separation piece 420C, since the physical distance between the separation piece 420C and the main body portions 430C is short. Therefore, arcs may be generated between the separation piece 420C and the end portions 431C of the main body portions 430C which are the boundaries with the separation piece 420C. However, as shown in FIG. 18, the arcs generated from the end portions 431C of the main body portions 430C are released to the first arc extinguishing space X1C located between the separation piece 420C and the main body portions 430C, and is extinguished by the arc extinguishing material M in the first arc extinguishing space X1C.

Further, the first arc extinguishing space X1C which extends vertically is located at a position facing the main body portions 430C even when the moving body 500C further moves inside the cylindrical portion 310 toward the second end portion 330. Therefore, even if a voltage is applied between the main body portions 430C on both sides, and arcs are generated from the end portions 431C of the main body portions 430C, the arcs are extinguished by the arc extinguishing material M in the first arc extinguishing space X1C, and it is possible to prevent the arcs from connecting between the main body portions 430C and causing a current to flow in the electric circuit. If a high voltage is applied between the main body portions 430C on both sides and the arcs cannot be effectively extinguished with the arc extinguishing material M, a mode in which the arcs are effectively confined by insulating spaces 550D as described later with reference to FIG. 22 may be adopted.

As described above, according to the electric circuit breaker 600C according to the fourth embodiment of the present disclosure, the moving body 500C itself cuts the cut portion 400 and includes the first arc extinguishing space X1 filled with the arc extinguishing material M, and the first arc extinguishing space X1 is configured to be located between the separation piece 420C that is cut and separated and the main body portions 430C that remain in the housing 300 without being separated immediately after the separation piece 420 is cut and the electric circuit is cut off. Therefore, the arcs generated from the main body portions 430C can be effectively extinguished by the arc extinguishing material M in the first arc extinguishing space X1 immediately after the cut portion 400 is cut and the electric circuit is cut off.

Further, according to the electric circuit breaker 600C of the present disclosure, when the predetermined first overcurrent flows, the cut portion 400C constituted by the fuse can be fused to cut off the electric circuit, and when the predetermined second overcurrent flows, the cut portion 400C itself can be physically cut by the electric circuit breaker 600C to cut off the electric circuit. Since the cut portion 400C having the fuse function is accommodated in the electric circuit breaker 600C, a space for arranging and connecting both the fuse and the electric circuit breaker in series is unnecessary, Further, since the cut portion 400C is accommodated in the first arc extinguishing space X1C filled with the arc extinguishing material M, when the cut portion 400C constituted by the fuse is fused by the predetermined first overcurrent, even if an arc is generated from the cut portion 400C, the arc extinguishing material M in the first arc extinguishing space X1C effectively extinguishes the arc.

In the mode of the electric circuit breaker 600C according to the fourth embodiment of the present disclosure, the cut portion 400C having the fuse function is accommodated in the electric circuit breaker 600C, but the present disclosure is not limited to this. A mode in which the electric circuit breaker 600 according to the first embodiment of the present disclosure and the fuse are connected in series may be adopted, and any mode can be appropriately adopted.

In the prior art shown in FIG. 23, in order to extinguish an arc, it is also conceivable to enclose a granular solid arc extinguishing material in cutting chambers 721. However, if the arc extinguishing material is enclosed in the cutting chambers 721, it may disturb a punching operation of a punch 730, so that it is difficult to fill the arc extinguishing material in the cutting chambers 721. However, in the present disclosure, unlike the prior art, the arc extinguishing material M can be accommodated in the moving body 500C itself instead of in the cylindrical portion 310, so that the operation of the moving body 500C that moves inside the cylindrical portion 310 and cuts the separation piece 420C is not disturbed. Further, since the separation piece 420C is accommodated in the moving body 500C and moves together with the moving body 500C, there is no risk of disturbing the punching operation of the punch unlike the prior art. Since the arc extinguishing material M and the separation piece 420C are both accommodated in the moving body 500C and move together with the moving body 500C, a large amount of the arc extinguishing material M can be accommodated in the moving body 500C unlike the prior art. Furthermore, since the first arc extinguishing space X1C can be expanded according to the volume inside the moving body 500C, a large amount of the arc extinguishing material M can be accommodated and the arc extinguishing performance is extremely high.

Fifth Embodiment

Next, an electric circuit breaker 600D according to a fifth embodiment of the present disclosure will be described with reference to FIGS. 19 to 22. In the electric circuit breaker 600D according to the fifth embodiment of the present disclosure, the bent portions 440A can be used together, like the cut portion 400A of the electric circuit breaker 600A according to the second embodiment shown in FIG. 9. Further, FIG. 19(*a*) is a perspective view of a moving body 500D of the electric circuit breaker 600D according to the fifth embodiment of the present disclosure, FIG. 19(*b*) is a front view of the moving body 500D, and FIG. 19(*c*) is a side view of the moving body 500D. Further, the configuration of the electric circuit breaker 600D according to the fifth embodiment is basically the same as the configuration of the electric circuit breaker 600C according to the fifth embodiment, except that the moving body 500D has insulating spaces, and hence detailed description of the same configurations will be omitted. Further, the insulating spaces 550D of the moving body 500D according to the fifth embodiment have the same configuration as the insulating spaces 550 of the moving body 500 shown in FIG. 3, and exhibit the same effect.

Figure 19A:
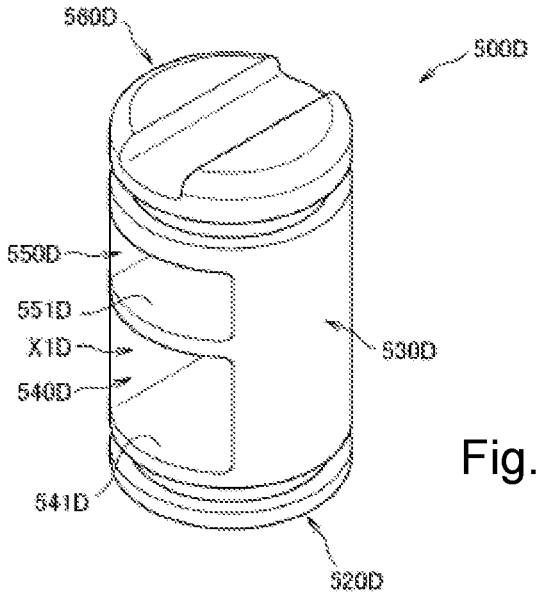
FIG. 19(*a*) is a perspective view of a moving body of an electric circuit breaker according to a fifth embodiment of the present disclosure, FIG. 19(*b*) is a front view of the moving body, and FIG. 19(*c*) is a side view of the moving body.
Figure 19B:
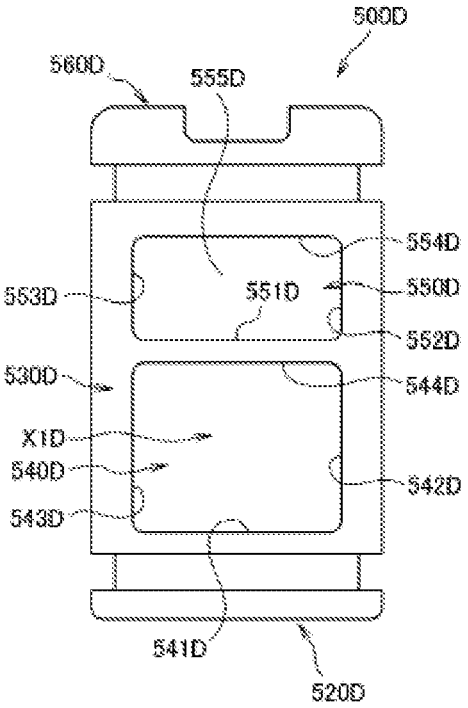
Figure 19C:
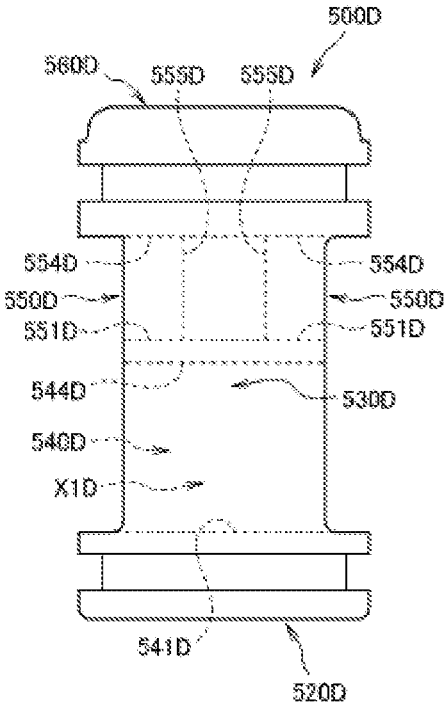

First, the moving body 500D is a substantially columnar body made of synthetic resin and having an upper surface 560D and a lower surface 520D. Further, on the lower surface 520D side of the moving body 500D, there is provided a penetrating portion 540D which penetrates the moving body 500D from one part of the outer surface 530D to another part of the outer surface 530D on the opposite side, that is, from the front surface to the back surface of the moving body 500D, and the penetrating portion 540D is surrounded by a lower wall 541D, a side wall 542D, a side wall 543D, and an upper wall 544D. A space surrounded by the lower wall 541D, the side wall 542D, the side wall 543D, and the upper wall 544D and recessed inward from the outer surface 530D is a first arc extinguishing space X1D. Then, in the first arc extinguishing space X1D, the separation piece 420C of the cut portion 400C described later can be inserted and accommodated. Further, in the first arc extinguishing space X1D, since an arc extinguishing material described later is filled, the periphery of the separation piece 420C of the cut portion 400C accommodated in the first arc extinguishing space X1D can be completely surrounded by the arc extinguishing material Further, insulating spaces 550D that are recessed inward from the outer surface 530D are formed on the upper surface 560D side of the moving body 500D. The insulating spaces 550D are formed at opposite positions on the outer surface 530D. The insulating spaces 550D are each surrounded by a lower wall 551D, a side wall 552D, a side wall 553D, an upper wall 554D, and a rear wall 555D. As shown in FIG. 19(*c*), the insulating spaces 550D arranged so as to face each other are shielded from each other by the rear wall 555D, and are spaces insulated from each other. An arc extinguishing material is not accommodated in the insulating spaces 550D, and an arc is confined and shielded as will be described later. Further, the insulating spaces 550D and the first arc extinguishing space X1D are also shielded from each other by the lower walls 551D and the upper walls 544D, and are independent spaces insulated from each other.

Figure 20:
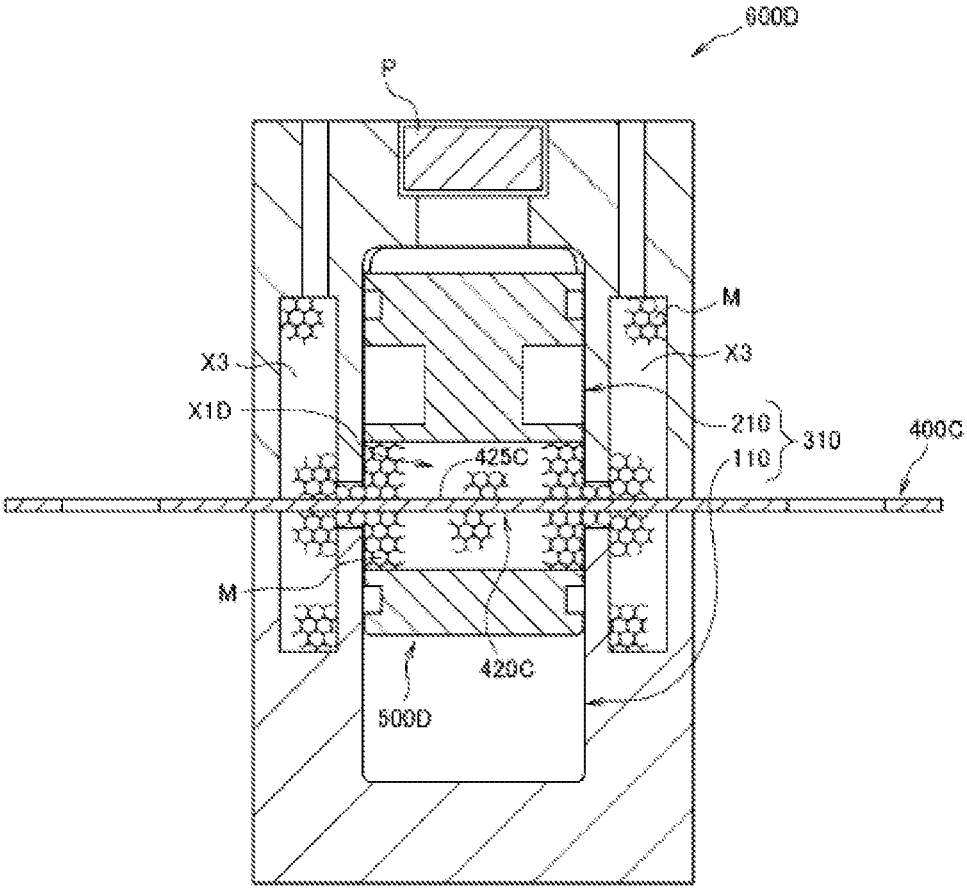
FIG. 20 is a cross-sectional view of the electric circuit breaker according to the fifth embodiment of the present disclosure.

Next, the internal structure and the usage mode of the electric circuit breaker 600D according to the fifth embodiment of the present disclosure will be described with reference to FIG. 20. The electric circuit breaker 600D according to the fifth embodiment of the present disclosure is assembled in the same manner as the electric circuit breaker 600C according to the fourth embodiment of the present disclosure, and the assembly of the electric circuit breaker 600D is completed by replacing the moving body 500C of the electric circuit breaker 600C shown in FIG. 17 with the moving body 500D of the electric circuit breaker 600D shown in FIG. 19. FIG. 20 is a cross-sectional view showing the electric circuit breaker 600D according to the fifth embodiment of the present disclosure, in which the moving body 500C of FIG. 17 is replaced with the moving body 500D.

Figure 21:
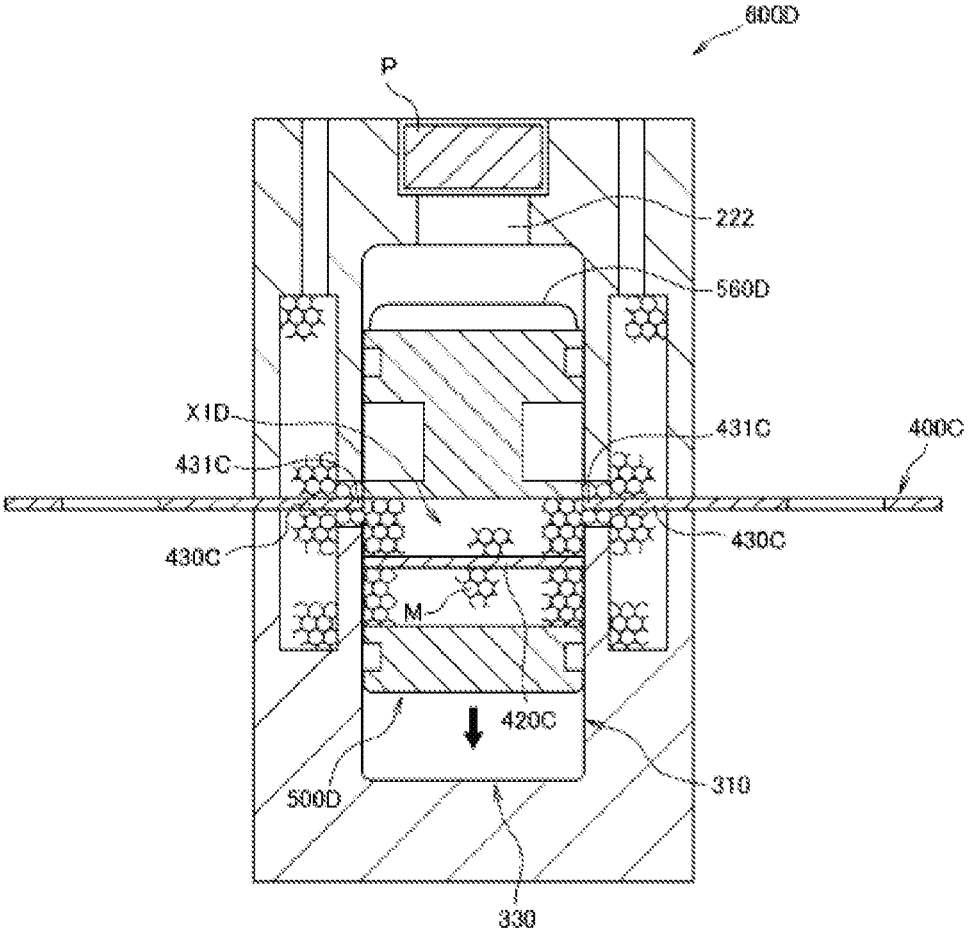
FIG. 21 is a cross-sectional view showing a state where the moving body moves from the state shown in FIG. 20.
Figure 22:
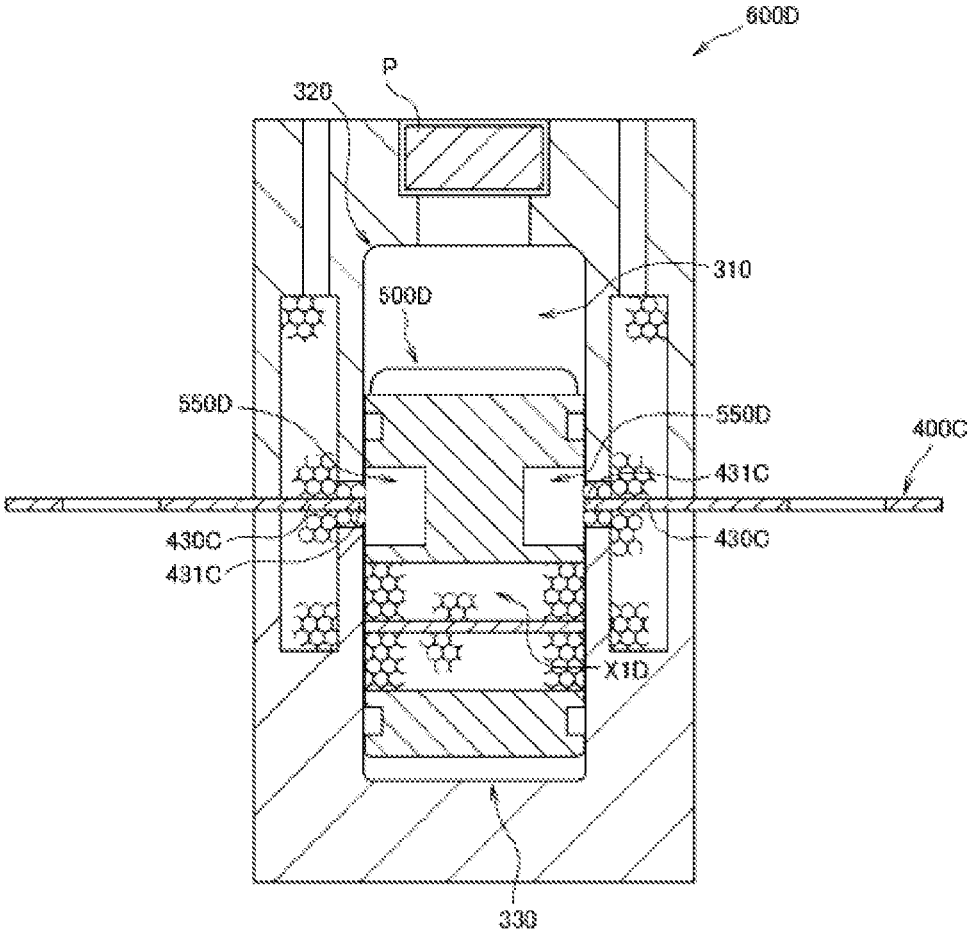
FIG. 22 is a cross-sectional view showing a state where the moving body further moves from the state shown in FIG. 21.

As shown in FIG. 20, the moving body 500D is accommodated inside the cylindrical portion 310 composed of the lower cylindrical portion 110 and the upper cylindrical portion 210 which are linearly arranged. The granular arc extinguishing material M is accommodated in the first arc extinguishing space X1D and the third arc extinguishing spaces X3. Since the separation piece 420C of the cut portion 400C is accommodated by being inserted through the inside of the first arc extinguishing space X1D of the moving body 500D, the arc extinguishing material M covers the periphery of the fusing portion 425C of the cut portion 400C. In FIGS. 20 to 22, although the entire first arc extinguishing space X1D and the entire third arc extinguishing spaces X3 are filled with the arc extinguishing material M, only a part of the arc extinguishing material M is shown on the drawing for the sake of visibility.

Then, when the predetermined first overcurrent (for example, a relatively high abnormal overcurrent) flows in the electric circuit, the fusing portion 425C of the cut portion 400C connected to the electric circuit heats and is fused, and the electrical circuit is cut off and protected from an overcurrent. Further, even when an arc is generated from the periphery of the fusing portion 425C during or after the fusing portion 425C of the cut portion 400C is fused, the arc is effectively extinguished by the arc extinguishing material M in the periphery of the fusing portion 425C. Further, the cut portion 400C is accommodated in the first arc extinguishing space X1D filled with the arc extinguishing material M, and the cut portion 400C is not held in direct contact with the moving body 500D. Therefore, even when an arc is generated from the cut portion 400C, it is possible to prevent the moving body 500D made of synthetic resin from being carbonized, On the other hand, as shown in FIG. 21, when an abnormality such as the predetermined second overcurrent (for example, a relatively low abnormal overcurrent) flowing in the electric circuit is detected, an abnormality signal is input to the power source P, and the explosive powder in the power source P explodes. Then, the air pressure due to the explosion is instantaneously transmitted to the upper surface 560D of the moving body 500D via the communication hole 222, and instantaneously moves inside the cylindrical portion 310 toward the second end portion 330. FIG. 21 is a cross-sectional view showing a state where the moving body 500D moves from the state shown in FIG. 20.

Then, the moving body 500D cuts the separation piece 420C and separates it from the main body portions 430C by the force of pushing out the moving body 500C toward the second end portion 330. Specifically, since the arc extinguishing material M is filled inside the first arc extinguishing space X1D, when the moving body 500D moves, the separation piece 420C is also instantly pushed out with a strong force toward the second end portion 330 together with the arc extinguishing material M in the vicinity and is cut from the main body portions 430C. Then, the separation piece 420C moves toward the second end portion 330 together with the moving body 500D, and separates from the main body portions 430C.

Further, as shown in FIG. 21, the first arc extinguishing space X1D is located at a position facing the main body portions 430C immediately after the moving body 500D moves inside the cylindrical portion 310 toward the second end portion 330. Therefore, the first arc extinguishing space X1D is configured to be located between the separation piece 420C and the main body portions 430C immediately after the moving body 500D cuts the separation piece 420C. Then, immediately after the moving body 500D cuts the separation piece 420C, since the physical distance between the separation piece 420C and the main body portions 430C is short. Therefore, arcs may be generated between the separation piece 420C and the end portions 431C of the main body portions 430C which are the boundaries with the separation piece 420C. However, as shown in FIG. 21, the arcs generated from the end portions 431C of the main body portions 430C are released to the first arc extinguishing space X1D located between the separation piece 420C and the main body portions 430C, and is extinguished by the arc extinguishing material M in the first arc extinguishing space X1D.

Next, a state where the moving body 500D further moves toward the second end portion 330 will be described with reference to FIG. 22. FIG. 22 is a cross-sectional view showing a state where the moving body 500D further moves from the state shown in FIG. 21. As shown in FIG. 22, when the moving body 500D further moves inside the cylindrical portion 310 toward the second end portion 330, the insulating spaces 550D formed above the first arc extinguishing space X1 move up to positions facing and adjacent to the main body portions 430. Even if a high voltage is applied between the main body portions 430C on both sides and arcs are generated from the end portions 431C of the main body portions 430C, the arcs are confined in the insulating spaces 550D. The arcs generated between the main body portions 430C on both sides are confined in the insulating spaces 550D and insulated from each other, so that it is possible to prevent the arcs from connecting between the main body portions 430C on both sides and causing a current to flow in the electric circuit.

It is desirable that the arc extinguishing material M be not accommodated in the insulating spaces 550D. When the arc extinguishing material M is accommodated in the insulating spaces 550D, the arc extinguishing material M may be exposed to high temperature and carbonized by the arcs generated from the main body portions 430C, and the carbonized portion becomes a path through which an electric current can flow, so that the arcs easily leak from the insulating spaces 550D. Further, in the insulating spaces 550D, instead of the arc extinguishing material M, an insulating material that is not carbonized by an arc may be accommodated, Further, the electric circuit breaker of the present disclosure is not limited to the above-described examples, various modifications and combinations are possible within the scope described in the claims and the scope of the embodiments, and the these modifications and combinations are included in the scope of right.

What is claimed is:

1. An electric circuit breaker, including a housing, a cut portion that is arranged in the housing and forms a part of an electric circuit, a cutting member that cuts the cut portion, and a power source arranged on a first end portion side of the housing, the electric circuit breaker comprising a moving body that includes the cutting member and a first arc extinguishing space adjacent to the cutting member, the moving body comprising a space that allows the cut portion to be inserted and accommodated therein by surrounding with an upper wall, a lower wall, and side walls, wherein the housing includes a cylindrical portion capable of moving the moving body between the first end portion and a second end portion on a side opposite to the first end portion, wherein the moving body is configured such that the cutting member provided in the moving body cuts the cut portion accommodated in the space of the moving body while the moving body moves from the first end portion toward the second end portion by the power source, and the cut portion moves along with the moving body while the cut portion remains accommodated in the space of the moving body, and wherein the first arc extinguishing space of the moving body is configured to be located between a separation piece of the cut portion that is cut and separated and a main body portion of the cut portion that remains in the housing without being separated when the moving body moves, wherein the first arc extinguishing space does not accommodate the main body portion of the cut portion remained not separated in the housing.

2. The electric circuit breaker according to claim 1, wherein the moving body includes a second arc extinguishing space on a side opposite to the first arc extinguishing space across the cutting member.

3. The electric circuit breaker according to claim 1, wherein the moving body includes insulating spaces that are insulated from each other, and wherein the insulating spaces are configured to face the main body portion of the cut portion when the moving body further moves toward the second end portion.

4. The electric circuit breaker according to claim 1, wherein the housing includes a third arc extinguishing space that accommodates an arc extinguishing material outside the cylindrical portion, and wherein the third arc extinguishing space allows the main body portion to be accommodated and inserted therein.

5. The electric circuit breaker according to claim 4, wherein a part of the main body portion of the cut portion includes a bent portion that is bent in the third outer arc extinguishing space.

6. An electric circuit breaker, including a housing, a cut portion that is arranged in the housing, forms a part of an electric circuit, and is constituted by a fuse, and a power source arranged on a first end portion side of the housing, the electric circuit breaker comprising a moving body that and includes a first arc extinguishing space filled with an arc extinguishing material, the moving body comprising a space that allows the cut portion to be inserted and accommodated therein by surrounding with an upper wall, a lower wall, and side walls, wherein the housing includes a cylindrical portion capable of moving the moving body between the first end portion and a second end portion on a side opposite to the first end portion, wherein the moving body is configured to cut the cut portion accommodated in the first arc extinguishing space of the moving body while moving from the first end portion toward the second end portion by the power source, and the cut portion moves along with the moving body while the cut portion remains accommodated in the space of the moving body, and wherein the first arc extinguishing space of the moving body is configured to be located between a separation piece of the cut portion that is cut and separated and a main body portion of the cut portion that remains in the housing without being separated when the moving body moves, wherein the first arc extinguishing space does not accommodate the main body portion of the cut portion remained not separated in the housing.

7. The electric circuit breaker according to claim 6, wherein the moving body includes insulating spaces that are insulated from each other, and wherein the insulating spaces are configured to face the main body portion of the cut portion when the moving body further moves toward the second end portion.

8. The electric circuit breaker according to claim 6, wherein the housing includes a third arc extinguishing space that accommodates an arc extinguishing material outside the cylindrical portion, and wherein the third arc extinguishing space allows the main body portion to be accommodated and inserted therein.

9. The electric circuit breaker according to claim 8, wherein a part of the main body portion of the cut portion includes a bent portion that is bent in the third outer arc extinguishing space.

* * * * *